US007520319B2

(12) United States Patent
Ohno

(10) Patent No.: US 7,520,319 B2
(45) Date of Patent: Apr. 21, 2009

(54) STACKING-TYPE, MULTI-FLOW, HEAT EXCHANGER

(75) Inventor: Takayuki Ohno, Isesaki (JP)

(73) Assignee: Sanden Corporation, Isesaki-shi, Gunma (JP)

( * ) Notice: Subject to any disclaimer, the term of this patent is extended or adjusted under 35 U.S.C. 154(b) by 671 days.

(21) Appl. No.: 11/050,811

(22) Filed: Jan. 27, 2005

(65) Prior Publication Data

US 2005/0173101 A1 Aug. 11, 2005

(30) Foreign Application Priority Data

Feb. 6, 2004 (JP) ..... 2004-030804

(51) Int. Cl.
*F28D 1/03* (2006.01)

(52) U.S. Cl. ..... 165/153; 165/149; 29/890.052

(58) Field of Classification Search ..... 165/149, 165/152, 153
See application file for complete search history.

(56) References Cited

U.S. PATENT DOCUMENTS 4,678,112 A 7/1987 Koisuka et al.
4,969,312 A 11/1990 Hisso et al.
5,088,193 A 2/1992 Okada et al.
5,099,576 A 3/1992 Shinmura
5,101,887 A 4/1992 Kado
5,119,552 A 6/1992 Sutou et al.
5,125,453 A * 6/1992 Bertrand et al. ..... 165/153
5,172,762 A 12/1992 Shinmura et al.
5,174,373 A 12/1992 Shinmura
5,211,222 A 5/1993 Shinmura
5,214,847 A 6/1993 Aoki
5,265,672 A 11/1993 Aoki
5,336,524 A * 8/1994 Tanaka et al. ..... 427/240
5,348,079 A 9/1994 Tanaka
5,413,169 A * 5/1995 Frazier et al. ..... 165/153
5,505,254 A 4/1996 Chiba
5,632,331 A 5/1997 Shinmura
5,782,291 A 7/1998 Morita
5,785,119 A 7/1998 Watanabe et al.
5,894,886 A 4/1999 Chiba et al.
5,896,916 A * 4/1999 Baechner et al. ..... 165/78
5,934,367 A 8/1999 Shimmura et al.
5,960,864 A 10/1999 Morita
5,975,197 A 11/1999 Kado
6,035,931 A 3/2000 Kado et al.
6,070,659 A 6/2000 Hosoya (Continued)

FOREIGN PATENT DOCUMENTS

JP 10078269 A * 3/1998

*Primary Examiner*—Allen J Flanigan
(74) *Attorney, Agent, or Firm*—Baker Botts L.L.P.

(57) ABSTRACT

A stacking-type, multi-flow, heat exchanger includes a plurality of heat transfer tubes and fins stacked alternately, a tank formed at an end of the heat transfer tubes, and an end plate provided at an end of the tank. The heat exchanger has a projecting portion provided to a surface of an outermost tube plate, a raised portion with an opening formed through the projecting portion, and an engaging portion and a closing portion provided integrally to the end plate for engaging the raised portion and for closing an opening of the raised portion. A positional shift of the end plate at the time of temporary assembling may be prevented, and the brazing properties and the pressure resistance of the tank end portion may be increased.

15 Claims, 24 Drawing Sheets

U.S. PATENT DOCUMENTS 6,241,011 B1 * 6/2001 Nakamura et al. ..... 165/153
6,257,325 B1 7/2001 Watanabe et al.
6,408,940 B1 * 6/2002 Naji et al. ..... 165/153
6,510,893 B1 * 1/2003 Naji et al. ..... 165/135
6,585,038 B2 * 7/2003 Bousquet et al. ..... 165/153
6,607,026 B1 * 8/2003 Naji et al. ..... 165/153
6,786,277 B2 * 9/2004 Hark et al. ..... 165/178

* cited by examiner

STACKING-TYPE, MULTI-FLOW, HEAT EXCHANGER

BACKGROUND OF THE INVENTION

This application claims the benefit of Japanese Patent Application No. 2004-30804, filed Feb. 6, 2004, which is incorporated herein by reference.

1. Field of the Invention

The present invention relates to a stacking-type, multi-flow, heat exchanger comprising an end plate connected to an outermost layer of a heat exchanger core formed by stacking heat transfer tubes and fins alternately, and to methods for manufacturing such heat exchangers. Specifically, the present invention relates to an improved structure of a stacking-type, multi-flow, heat exchanger suitable as a heat exchanger for use in an air conditioner, in particular, for vehicles.

2. Description Related Art

A stacking-type, multi-flow, heat exchanger having alternately stacked heat transfer tubes and fins is known in the art, for example, as a heat exchanger having a structure shown in FIGS. 22 and 23 (as shown in Japanese Utility Model Laid-Open No. 7-12778). In FIGS. 22 and 23, a heat exchanger 101 has a heat exchanger core 104 formed by heat transfer tubes 102 and fins 103 i.e., (outer fins) stacked alternately. A side tank 105 is provided on one end of heat exchanger core 104 in the stacking direction, for forming introduction/discharge passages of a heat exchange medium (e.g., refrigerant), and a flange 106 connected with an expansion valve (not shown) is connected to side tank 105. On the other end of heat exchanger core 104, an end plate 107 is provided.

Each heat transfer tube 102 is formed by connecting (e.g., brazing) a pair of tube plates 108, which have the same configuration, to each other. Projecting portions 109 and 110 are provided on both ends of each tube plate 108 for forming tanks 111 and 112 at the upper and lower portions of heat exchanger core 104. Communication holes 113 and 114 for a heat exchange medium are formed through projecting portions 109 and 110. To form heat transfer tube 102, a pair of tube plates 108 are connected to each other, so that the respective projecting portions 109 and 110 are set at opposite sides, and projecting portions 109 and projecting portions 110 of a plurality of heat transfer tubes 102 are connected to each other, respectively, to form tanks 111 and 112 at either end of heat exchanger core 104. Communication holes 113 and 114 of outermost tube plate 108 at the end plate side are closed by projecting portions 115 and 116 of end plate 107, respectively.

Heat exchanger 101 may be manufactured by temporarily assembling the respective members, and brazing the assembly at a later time in a furnace, wherein the assembly is held from both sides of heat exchanger 101 in the stacking direction by a brazing jig (not shown).

In such a manufacturing method, however, because projecting portions 109 and 110 of heat transfer tubes 102, and projecting portion 109 (110) of outermost tube plate 108 and projecting portion 115 (116) of end plate 107, are assembled, such that they are in surface contact, a positional shift may occur when assembled or during brazing in a furnace. Consequently, the respective parts may not be connected properly.

To solve such a problem, Japanese Published Patent Application No. JP-A-5-87482 proposes the following structure, as depicted in FIG. 24. In this structure, each heat transfer tube 117 is formed by a first tube plate 118 and a second tube plate 119. A raised portion 122 is formed by creating a lip or edge on a projecting portion 121 for forming a tank of second tube plate 119, and raised portion 122 is inserted into a communication hole 123 formed through a projecting portion 120 of first tube plate 118 to prevent a positional shift at the time of the assembly. An opening 126 of raised portion 122 of outermost tube plate 119 is closed by a projecting portion 125 of an end plate 124.

In such a structure, however, because it is difficult to ensure a sufficiently large area for brazing between projecting portion 125 of end plate 124 and raised portion 122 of projecting portion 121 of outermost tube plate 119, insufficient brazing strength may be achieved. Further, because it is difficult to temporarily fix end plate 124 to outermost tube plate 119 with a high degree of accuracy when assembled, the brazing accuracy may be reduced.

SUMMARY OF THE INVENTION

Accordingly, it is an object of the present invention to provide improved structures of and methods for manufacturing stacking-type, multi-flow, heat exchangers, and especially, high-performance, stacking-type, multi-flow, heat exchangers, which may achieve a high degree of accuracy in the assembly of an end plate and various parts, and which may achieve a desirable connection of respective parts with both a high degree of accuracy in position and sufficient bonding strength, at a low cost.

To achieve the foregoing and other objects, the structure of a stacking-type, multi-flow, heat exchanger, according to the present invention, is provided. The stacking-type, multi-flow, heat exchanger, comprises a heat exchanger core comprising a plurality of heat transfer tubes each formed by connecting a pair of tube plates to each other and a plurality of fins, which are stacked alternately, and a tank portion formed at least at an end of the plurality of heat transfer tubes, and an end plate connected to an outermost tube plate of the heat exchanger core. The heat exchanger comprises a projecting portion provided on a surface of the outermost tube plate at least at an end portion of the outermost tube plate for forming a part of the tank, a raised portion with an opening formed on the projecting portion, and an engaging portion and a closing portion provided to the end plate for engaging the raised portion and for closing the opening of the raised portion.

In such a stacking-type, multi-flow, heat exchanger, because the engaging portion, which engages the raised portion of the outermost tube plate, is provided integrally to the end plate, the end plate may be readily positioned relative to the outermost tube plate with a high degree of accuracy, and may be temporarily secured surely for a proper assembly. Therefore, because a positional shift of the end plate during the temporary assembly may be reduced or prevented, the brazing properties (e.g., the brazing accuracy) of the end plate and, ultimately, of the respective parts, may be enhanced. Such an engaging function may be readily achieved by a combination of the raised portion and a hole provided on the end plate engaging the raised portion.

Further, because the closing portion, which closes the opening of the raised portion, is provided integrally to the end plate, the opening of the raised portion may be closed readily and certainly by setting the end plate. Further, because the periphery of the raised portion and the inner circumferential edge of the hole of the end plate and the end surface of the raised portion and the end plate may be more securely brazed, the brazing area between the end plate and the outermost tube plate may be enlarged, and the strength of the braze between both members may be increased. Such a closing function may be readily achieved by providing a lid to the end plate for closing the opening of the raised portion.

Such a lid may be formed integrally with the end plate. For example, an opening inserted with the raised portion is provided to the end plate, an extended portion is formed on an end of the end plate, and by turning back the extended portion to close the opening of the raised portion, the above-described lid, having the closing function, may be readily formed.

Further, the above-described end plate, having the hole for engaging the raised portion and the extended portion for forming the lid closing the opening of the raised portion, may be readily manufactured by a single process, such as pressing, stamping, or the like. Therefore, in the present invention, the number of parts and the number of processes, may not be increased substantially, and the cost for the manufacture may be reduced or prevented for rising.

Moreover, if the lid is formed to have a portion protruded from a position of the raised portion, the strength of the lid may be increased. Further, if the degree of protrusion of the protruded portion is set, so that an outer surface of the protruded portion and an outer surface of a portion of the end plate connected to an outermost fin are formed to be substantially flush, the temporarily assembled heat exchanger may be securely fixed by using a simple jig for brazing. Therefore, the brazing property may be significantly improved.

Thus, in the stacking-type, multi-flow, heat exchanger, according to the present invention, because the engaging portion and the closing portion are provided integrally to the end plate for engaging the raised portion of the outermost tube plate and for closing the opening of the raised portion (i.e., for closing an end of a tank), the end plate and, ultimately, the entire heat exchanger, may be assembled temporarily at a proper position with a high degree of accuracy, and the brazing properties may be significantly improved. Further, by providing the closing portion integrally to the end plate, increases in the number of the parts and the number of processes may be substantially prevented. This may contribute to lowering costs or reducing or eliminating cost increases.

In addition, a method for manufacturing a stacking-type, multi-flow, heat exchanger, in which the heat exchanger may comprise a heat exchanger core comprising a plurality of heat transfer tubes, is provided. The method comprises the steps of: forming the heat exchanger tubes by connecting a pair of tube plates to each other; stacking the plurality of tubes alternatively with a plurality of fins to form said core; and forming a tank portion at least at an end of the core by connecting an end plate to an outermost tube plate of the core. The tank portion is formed by providing a projecting portion on a surface of said outermost tube plate at least at an end portion of the outermost tube plate for forming a part of the tank, surrounding an opening formed through the projecting portion with a raised portion, and providing an engaging portion and a closing portion to the end plate for engaging the raised portion and for closing the opening of the raised portion.

Other objects, features, and advantages of the present invention will be apparent to persons of ordinary skill in the art from the following detailed description of preferred embodiments of the present invention and the accompanying drawings.

BRIEF DESCRIPTION OF THE DRAWINGS

For a more complete understanding of the present invention, the needs satisfied thereby, and the objects, features, and advantages thereof, reference now is made to the following description taken in connection with the accompanying drawings.

DETAILED DESCRIPTION OF PREFERRED EMBODIMENTS

Figure 1:
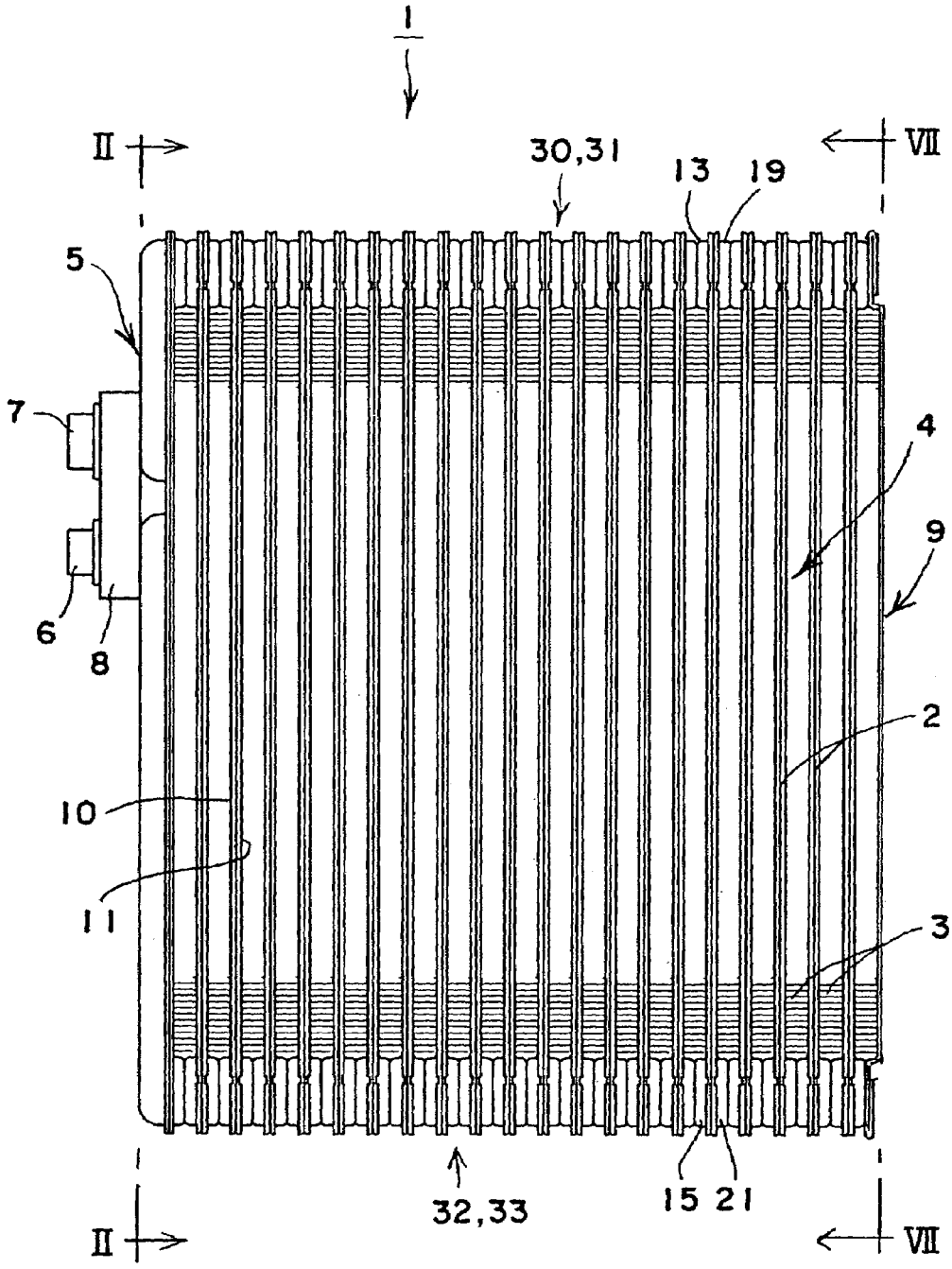
FIG. 1 is a side view of a stacking-type, multi-flow, heat exchanger, according to a first embodiment of the present invention.
Figure 2:
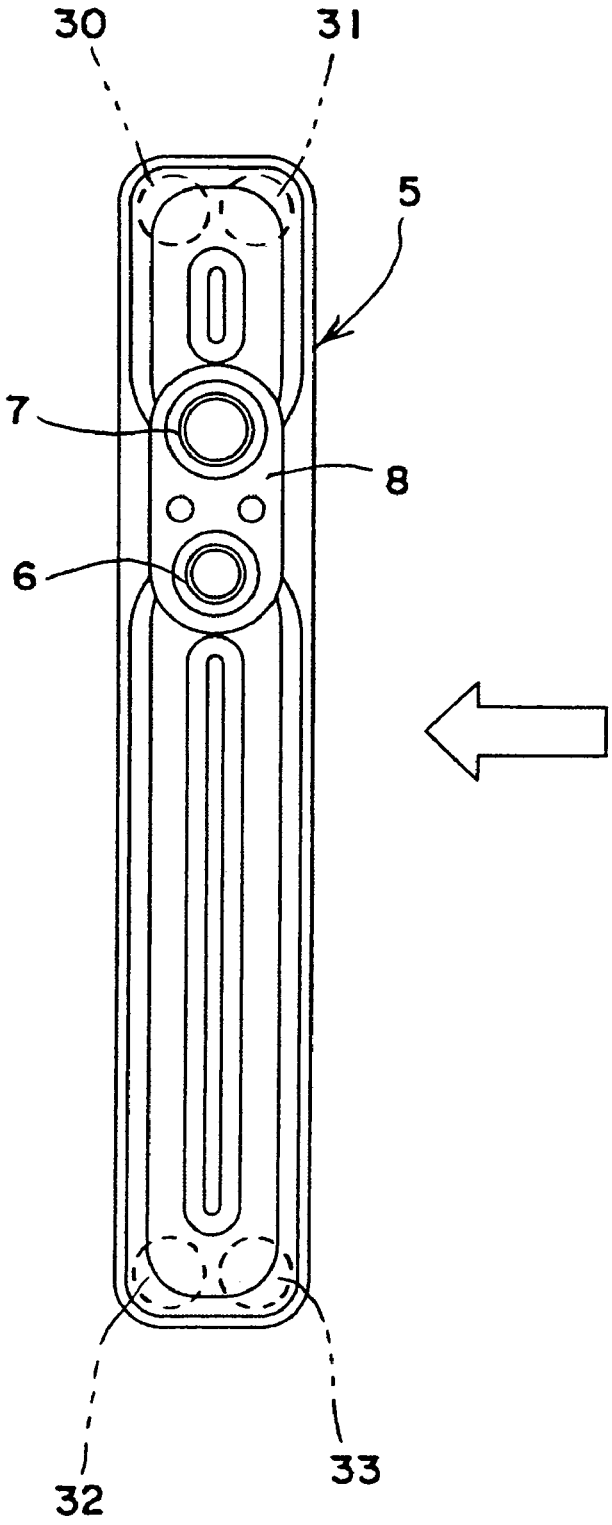
FIG. 2 is a vertical, cross-sectional view of the heat exchanger depicted in FIG. 1, as viewed along Line II-II of FIG. 1.

Referring to FIGS. 1-7, a heat exchanger is depicted according to a first embodiment of the present invention. Heat exchanger 1 is constructed as a stacking-type, multi-flow, heat exchanger. As depicted, heat exchanger 1 comprises a heat exchanger core 4 formed by a plurality of heat transfer tubes 2 and a plurality of outer fins 3 stacked alternately. A side tank 5 is connected to one end of heat exchanger core 4 in the stacking direction, and introduction/discharge passages of a heat exchange medium (e.g., refrigerant) into/from the heat exchanger are formed in the side tank 5. A flange 8 having an inlet 6 and an outlet 7 for heat exchange medium is connected to side tank 5. An end plate 9 is connected to the other end of heat exchanger core 4 in the stacking direction.

Figure 3:
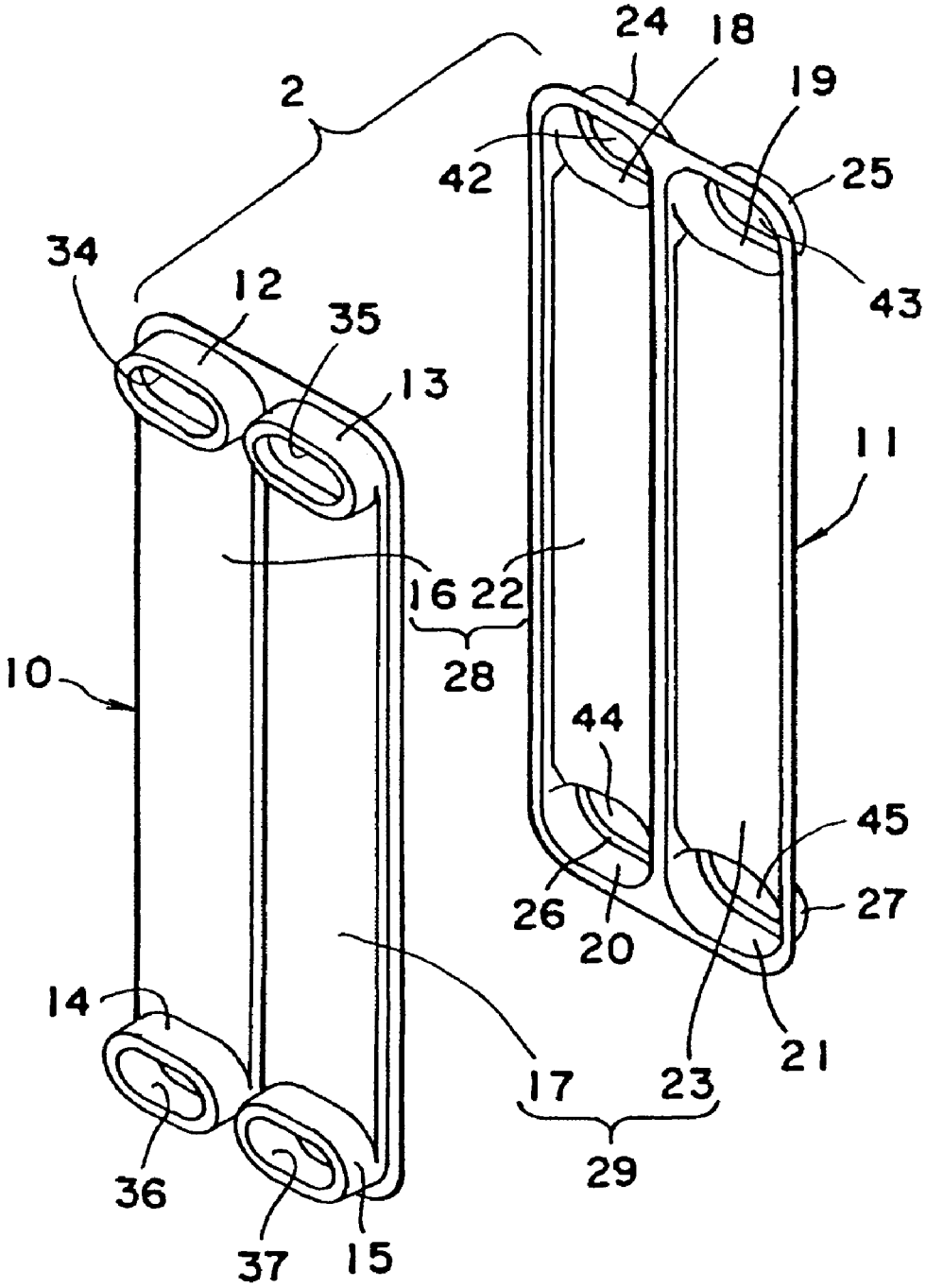
FIG. 3 is an exploded, perspective view of an outermost, heat transfer tube of the heat exchanger depicted in FIG. 1.
Figure 4:
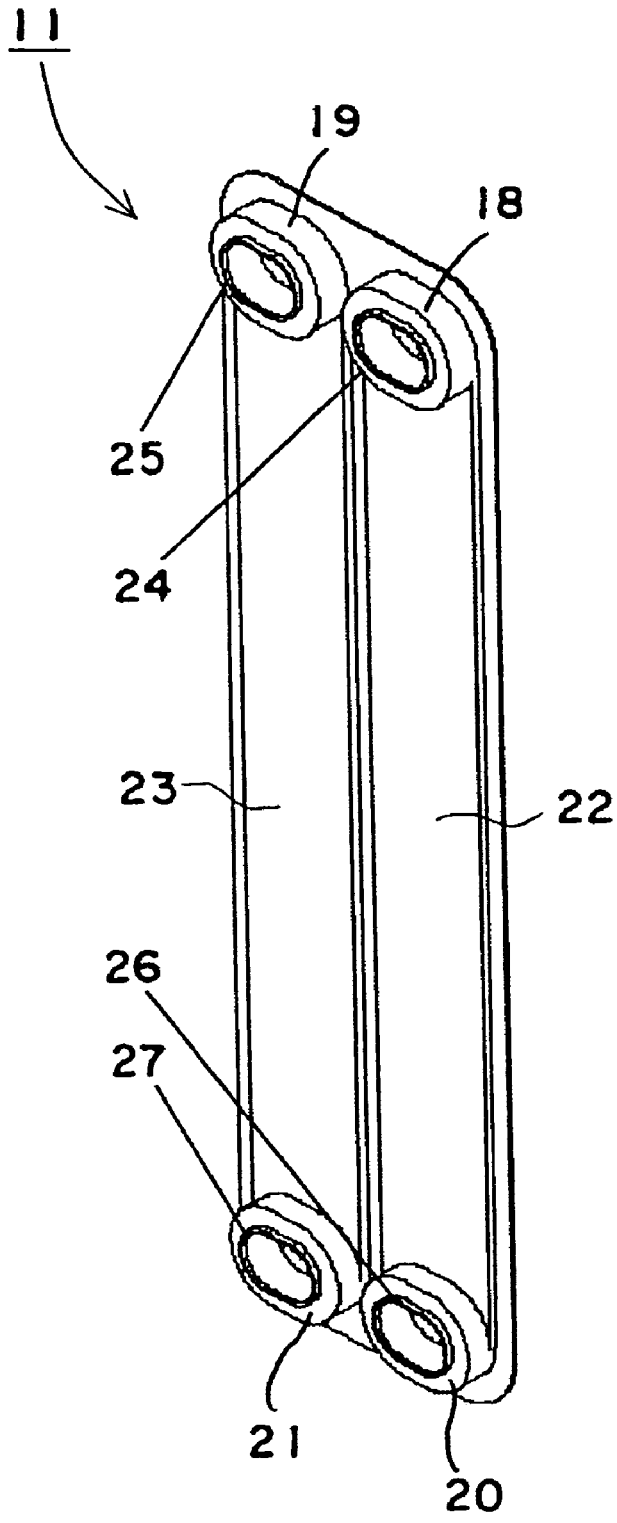
FIG. 4 is a perspective view of an outermost, tube plate of the heat exchanger depicted in FIG. 1.
Figure 5:
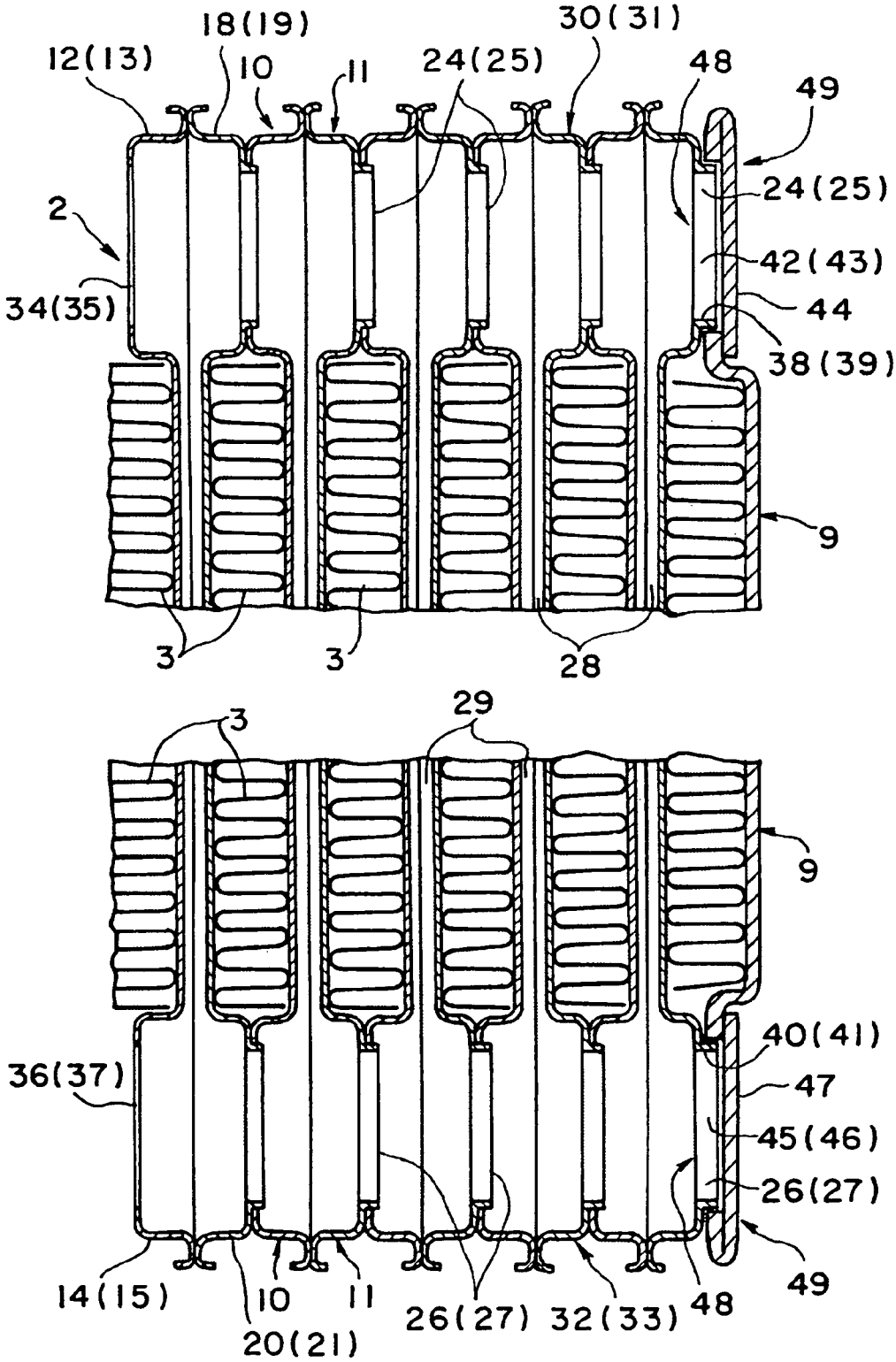
FIG. 5 is an enlarged, partial, vertical, cross-sectional view of the heat exchanger depicted in FIG. 1.

As depicted in FIGS. 3 and 5, each heat transfer tube 2 is formed by connecting a pair of tube plates 10 and 11 (i.e., a first tube plate 10 and a second tube plate 11) to each other at their outer circumferential portions. Projecting portions 12, 13, 14, and 15 projecting outwardly for forming tanks 30, 31, 32, and 33 are provided in first tube plate 10. Passage forming portions 16 and 17 extending along the longitudinal direction of first tube plate 10 are formed in first tube plate 10. Similarly, projecting portions 18, 19, 20, and 21 projecting outwardly for forming tanks 30, 31, 32, and 33 are provided in second tube plate 11. Passage forming portions 22 and 23 extending along the longitudinal direction of second tube plate 11 are formed in second tube plate 11. In this second tube plate 11, as depicted in FIGS. 4 and 5, raised portions 24, 25, 26, and 27 formed by stamping or the like are provided to projecting portions 18, 19, 20, and 21.

As depicted in FIGS. 3 and 5, inner passages for heat exchange medium 28 and 29 are formed between passage forming portions 16 and 22 and between passage forming portions 17 and 23 by connecting tube plates 10 and 11 to each other. An inner fin (not shown) may be inserted into each of passages 28 and 29. By stacking a plurality of heat transfer tubes 2 thus formed, tanks 30 and 31 are formed by projection portions 12 and 18 and projection portions 13 and 19 at one end of the tube in its longitudinal direction, and tanks 32 and 33 are formed by projection portions 14 and 20 and projection portions 15 and 21 at the other end of the tube in its longitudinal direction, respectively. When heat transfer tubes 2 are stacked, raised portions 24, 25, 26, and 27 provided on projecting portions 18, 19, 20, and 21 of second tube plates 11 are inserted into communication holes 34, 35, 36, and 37 formed through corresponding projecting portions 12, 13, 14, and 15 of first tube plates 10. Therefore, the whole of heat exchanger core 4 including the respective tanks may be assembled temporarily without any positional shift.

Raised portions 24, 25, 26, and 27 of second tube plate 11 of an outermost heat transfer tube 2 are inserted into holes 38, 39, 40, and 41 formed through end plate 9. In this embodiment, an engaging portion 48 is formed by inserting the respective raised portions into each of the corresponding holes of end plate 9.

Figure 6:
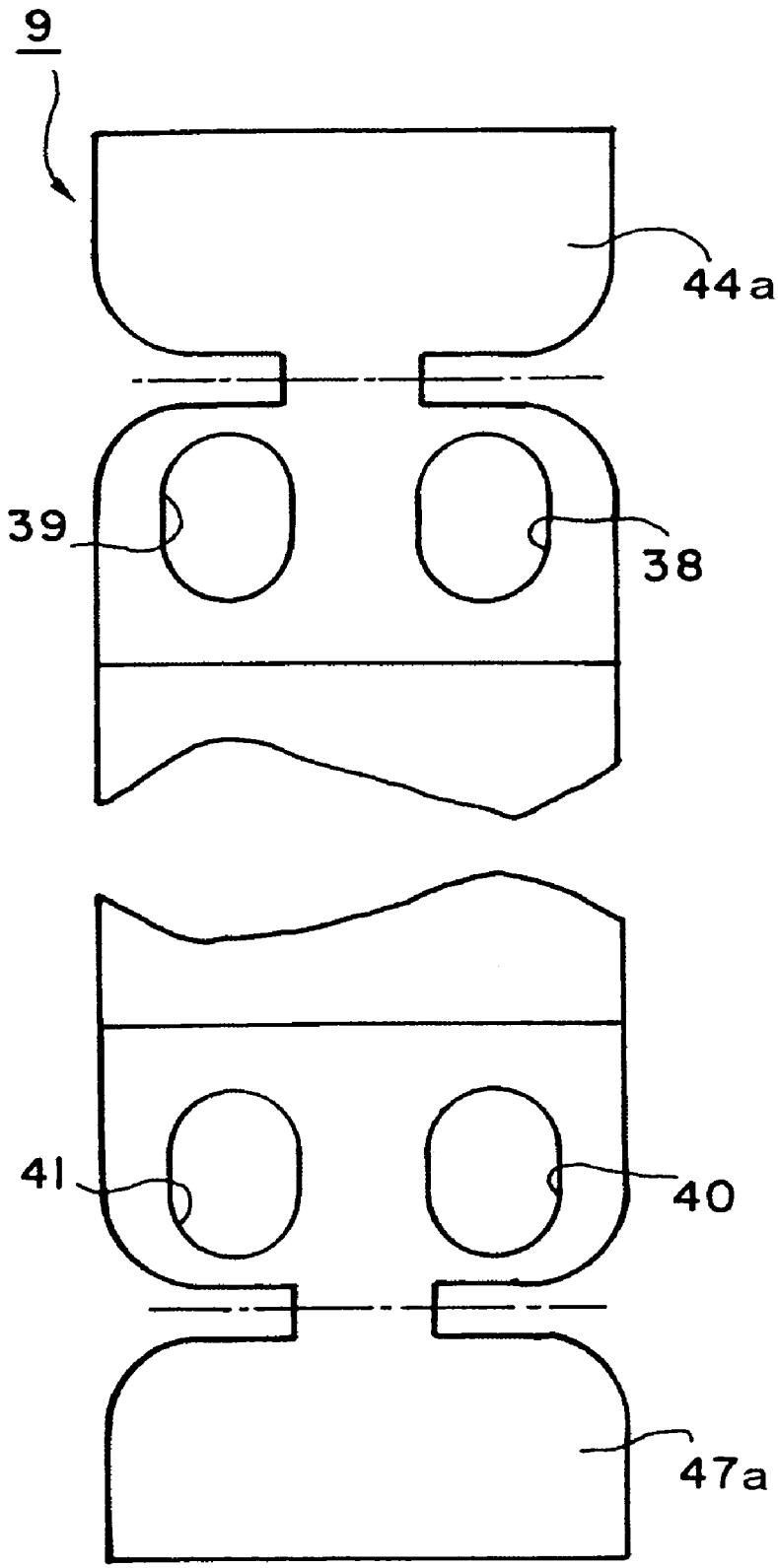
FIG. 6 is an enlarged, elevational view of an end plate of the heat exchanger depicted in FIG. 1.
Figure 7:
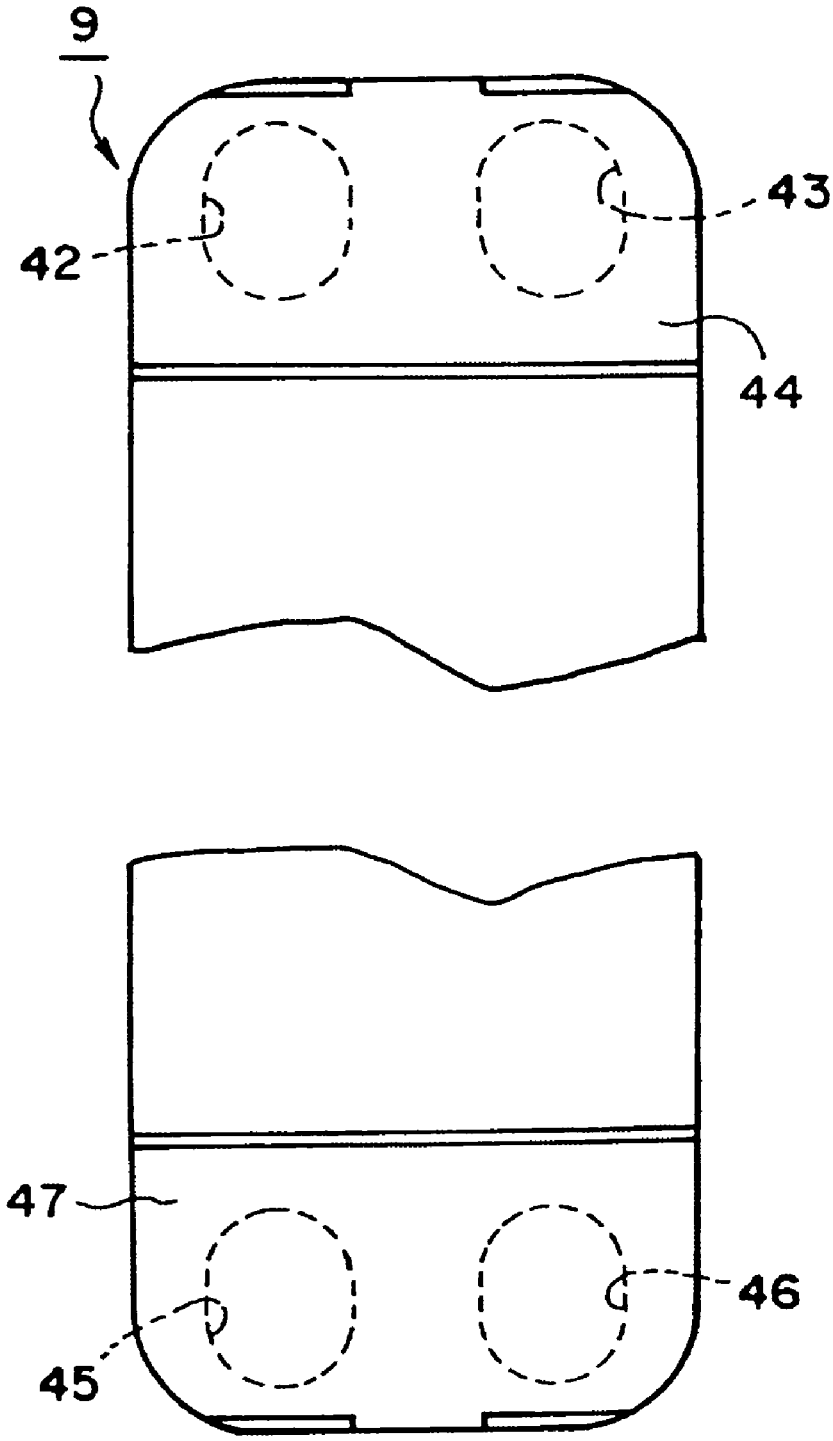
FIG. 7 is an enlarged, end view of the heat exchanger depicted in FIG. 1, as viewed along Line VII-VII of FIG. 1.

Openings 42 and 43 of raised portions 24 and 25 at one end of second tube plate 11 of the outermost, heat transfer tube 2 are closed by a lid 44 formed integrally with end plate 9. Openings 45 and 46 of raised portions 26 and 27 at the other end of second tube plate 11 of the outermost heat transfer tube 2 are closed by a lid 47 formed integrally with end plate 9. As depicted in FIG. 6, these lids 44 and 47 are formed by turning back extended portions 44*a* and 47*a*, formed integrally with end plate 9, at a position of the respective dashed lines of FIG. 6. By this turning-back process, openings 42, 43, 45, and 46 of raised portions 24, 25, 26, and 27 are closed by lids 44 and 47, as depicted in FIG. 7. These lids 44 and 47 form closing portions 49 for closing openings 42, 43, 45, and 46 of raised portions 24, 25, 26, and 27 of the outermost, heat transfer tube 2.

Thus, in this embodiment, engaging portions 48 and closing portions 49 are formed integrally with end plate 9. End plate 9 having the above-described holes 38, 39, 40 and 41 forming engaging portions 48 and lids 44 and 47 (i.e., extended portions 44*a* and 47*a*) forming closing portions 49 may be formed by a single process, such as pressing, stamping, or the like. Therefore, increases in the number of the parts and the number of the manufacturing method steps may be substantially prevented, and the cost for the manufacture may be effectively reduced or prevented from rising.

In heat exchanger 1 described above, the respective parts are assembled temporarily, and the assembly is brazed at a later time in a furnace. Therefore, if the positional relationship between the respective parts is not properly set, the brazing properties may be markedly reduce. In particular, in a known, stacking-type, multi-flow, heat exchanger, although an end plate is precisely positioned during assembly, it is difficult to maintain this positioning during brazing. Further, because the brazing area between an end plate and an outermost, tube plate (e.g., an outermost second tube plate) is limited, it is difficult to ensure a sufficient connection strength of this portion.

In this embodiment, however, engaging portion 48 and closing portion 49 are provided integrally to end plate 9. In particular, because respective raised portions 24, 25, 26, and 27 of second tube plate 11 of an outermost, heat transfer tube 2 are inserted into corresponding holes 38, 39, 40, and 41 formed through end plate 9, the end plate 9 may be accurately positioned relative to the outermost, second tube plate 11 of the outermost, heat transfer tube 2. Therefore, when temporarily assembled, a positional shift of end plate 9 may be reduced or prevented, end plate 9 and, ultimately, the entire heat exchanger 1 including other parts, may be maintained in position even during brazing, and the brazing properties may be significantly improved.

Moreover, lids 44 and 47 functioning as closing portions for closing openings 42, 43, 45, and 46 of respective raised portions 24, 25, 26, and 27 are provided integrally to end plate 9. Therefore, by forming extended portions 44*a* and 47*a* by pressing, stamping, or the like and turning back the extended portions 44*a* and 47*a* to engage outermost, second tube plate 11 and form lids 44 and 47, the openings 42, 43, 45, and 46 of respective raised portions 24, 25, 26, and 27 may be closed readily and securely. Further, in this embodiment, because the portions between the peripheries of respective raised portions 24, 25, 26, and 27 and the inner circumferential edges of corresponding holes 38, 39, 40, and 41 of end plate 9 and the portions between the end surfaces of respective raised portions 24, 25, 26, and 27 and the surfaces of corresponding lids 44 and 47 of end plate 9 are brazed, the size of brazing area may be maintained or increased. Therefore, the brazing properties therebetween may be increased, and the pressure resistance at the brazed portions may be increased.

Figure 8:
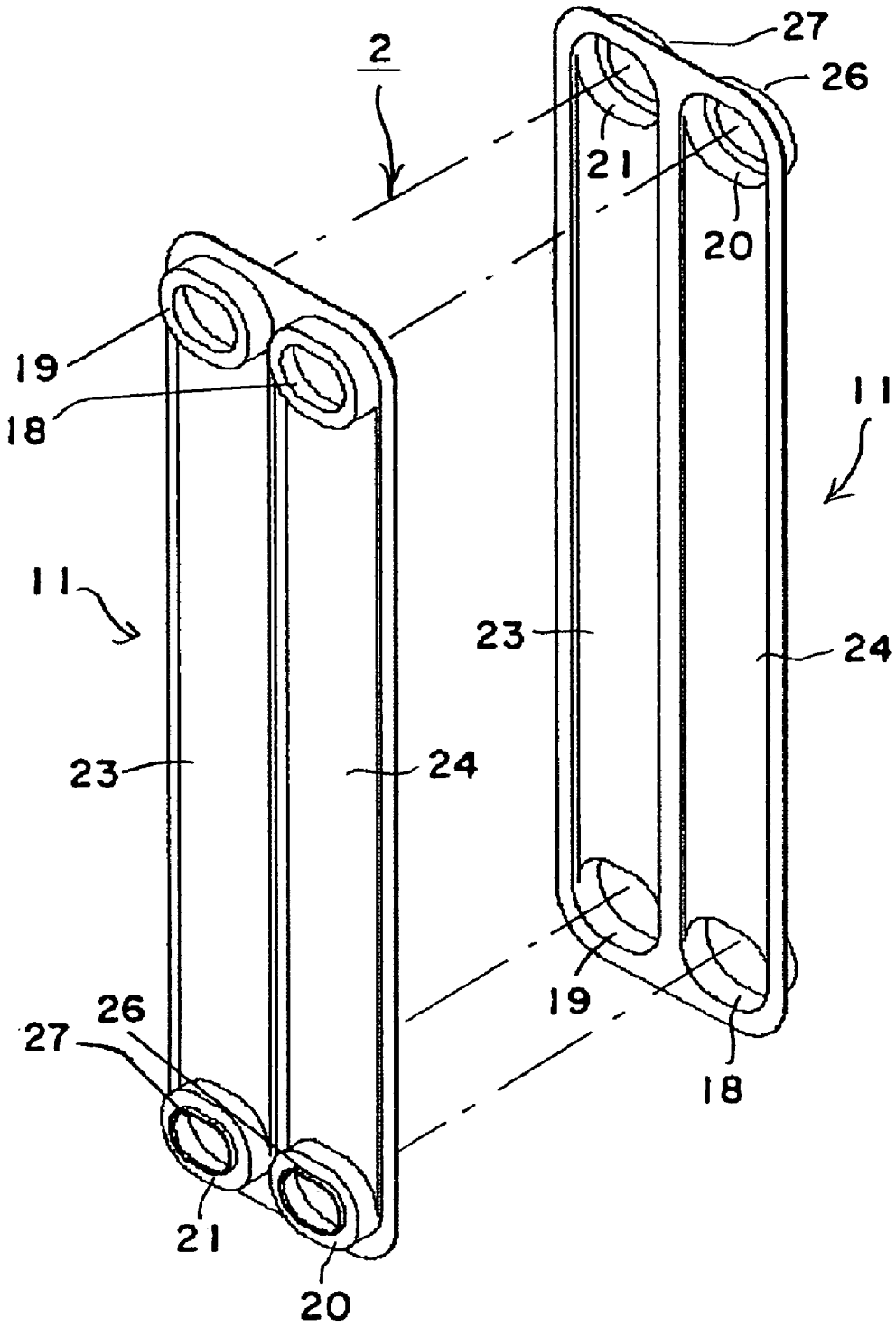
FIG. 8 is an exploded, perspective view of an outermost, heat transfer tube of the heat exchanger depicted in FIG. 1, showing another embodiment different from that depicted in FIG. 3.
Figure 9:
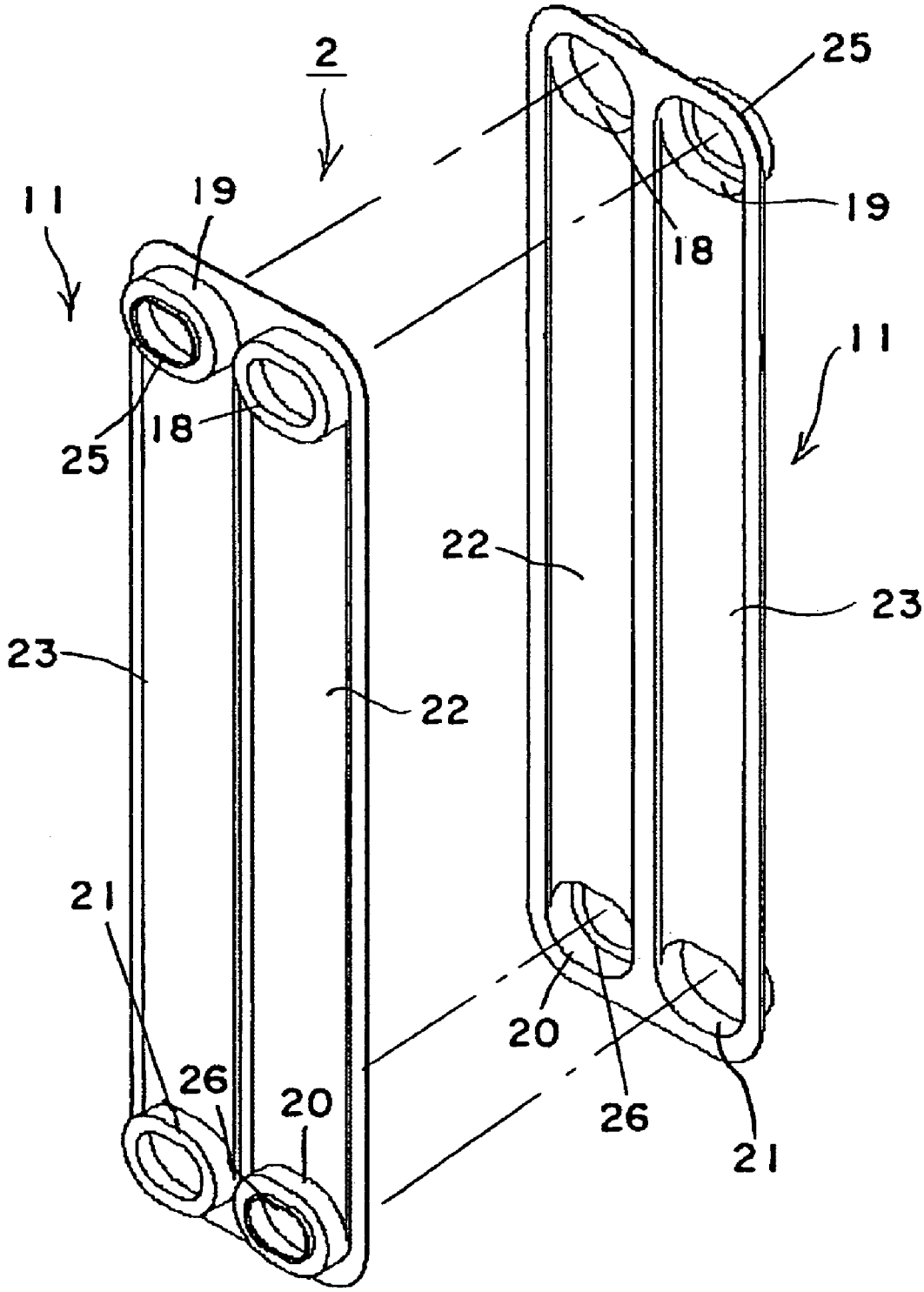
FIG. 9 is an exploded, perspective view of an outermost, heat transfer tube of the heat exchanger depicted in FIG. 1, showing a further embodiment different from that depicted in FIG. 3.

Although the raised portions are provided to all of the projecting portions of outermost, second tube plate 11 in the above-described embodiment, if a raised portion is provided to at least one projecting portion, the object of the present invention may be achieved. In particular, by engaging a raised portion, the outer shape of which is formed as an oval or the like, with a hole formed through end plate 9 with a corresponding shape, end plate 9 may be temporarily fixed relative to outermost, tube plate 11 with a high degree of accuracy, and therefore, the brazing properties may be improved. Further, as depicted in FIGS. 8 and 9, raised portions may be provided to any two projecting portions. By thus forming outermost, second tube plate 11, each of heat transfer tubes 2 may be formed from a pair of the same tube plates 11. For example, in the embodiment depicted in FIGS. 8 and 9, heat transfer tube 2 may be formed by connecting a tube plate 11 to another tube plate 11 having substantially the same structure, but reversed, in the vertical direction. Thus, when a plurality of projecting portions are provided, the object of the present invention may be achieved by forming a raised portion on at least one projecting portion.

Figure 10:
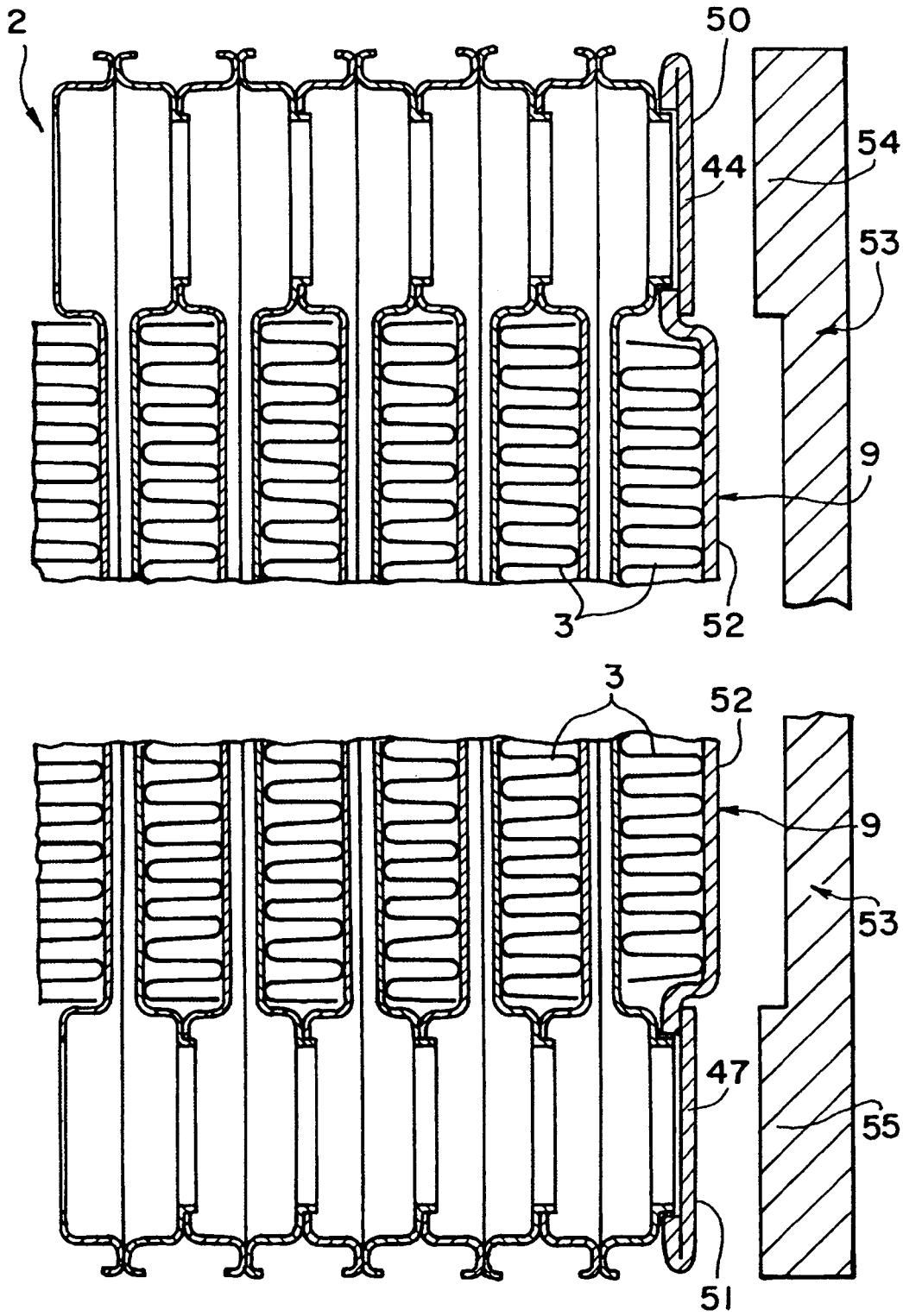
FIG. 10 is an exploded, vertical, cross-sectional view of the heat exchanger depicted in FIG. 1 and a jig, showing an assembly when the heat exchanger is brazed.

Further, outer surfaces 50 and 51 of lids 44 and 47 are not flush relative to outer surface 52 of a portion of end plate 9 connected to outermost, outer fin 3 in the above-described embodiment, as depicted in FIG. 10. Nevertheless, by forming portions 54 and 55 of a brazing jig 53 to be brought into contact with outer surfaces 50 and 51 of lids 44 and 47 as thicker portions, the securing function by brazing jig 53 may be exhibited more properly, and during brazing in a furnace, a positional shift of the parts of heat exchanger 1 assembled temporarily may be reduced or prevented.

Figure 11:
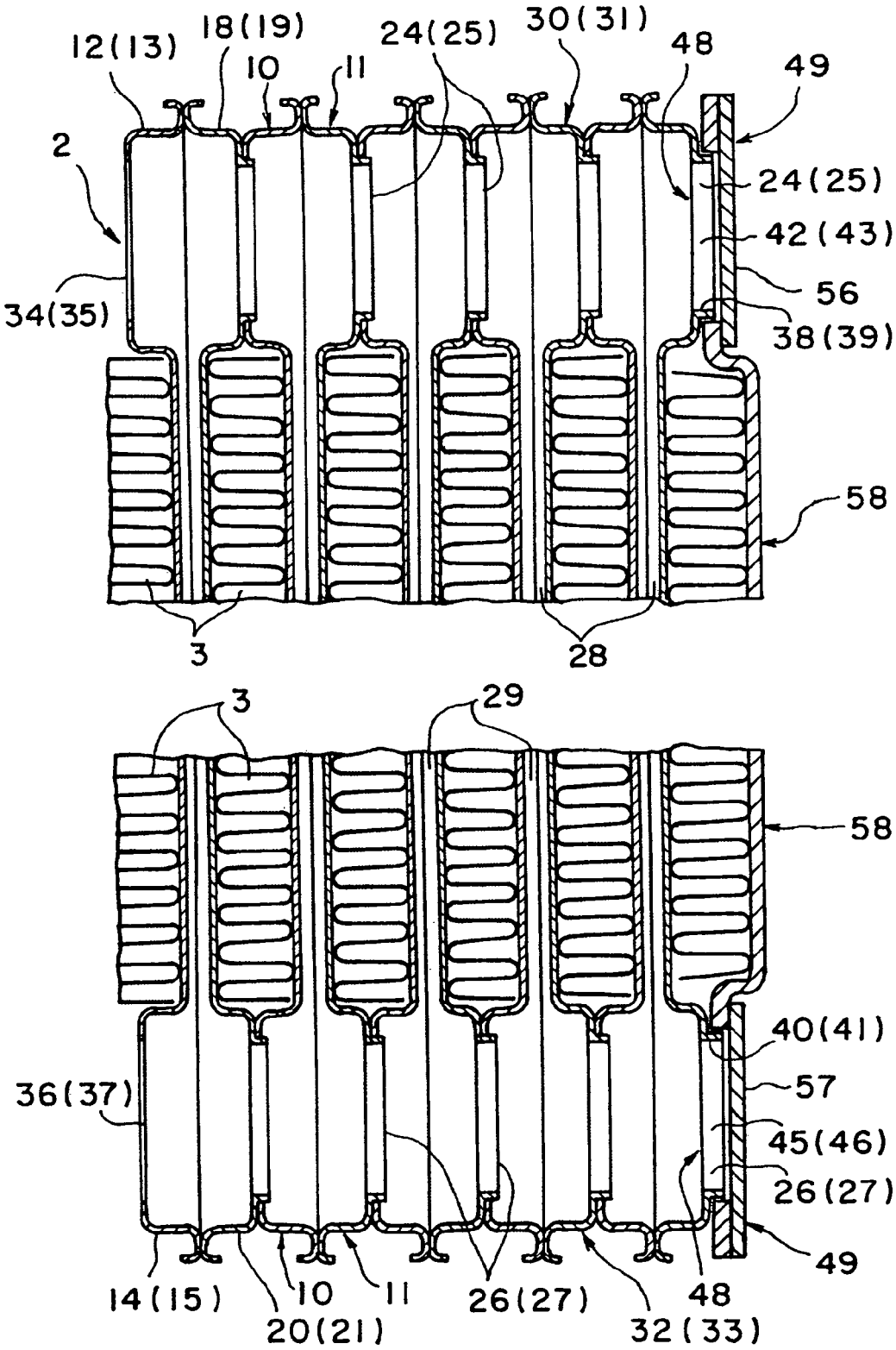
FIG. 11 is a partial, vertical, cross-sectional view of a stacking-type, multi-flow, heat exchanger, according to a second embodiment of the present invention.

FIG. 11 depicts a stacking-type, multi-flow, heat exchanger, according to a second embodiment of the present invention. The explanation of the same members as those described with respect to first embodiment is omitted by providing the same reference numerals as those in the first embodiment. In this embodiment, lids 56 and 57 closing openings 42, 43, 45, and 46 of raised portions 24, 25, 26, and 27 are formed separately from end plate 58. Moreover, in this embodiment, end plate 58 may be positioned with certainty and assembled with a high degree of accuracy, and the brazing properties and the pressure resistance may be increased.

Figure 12:
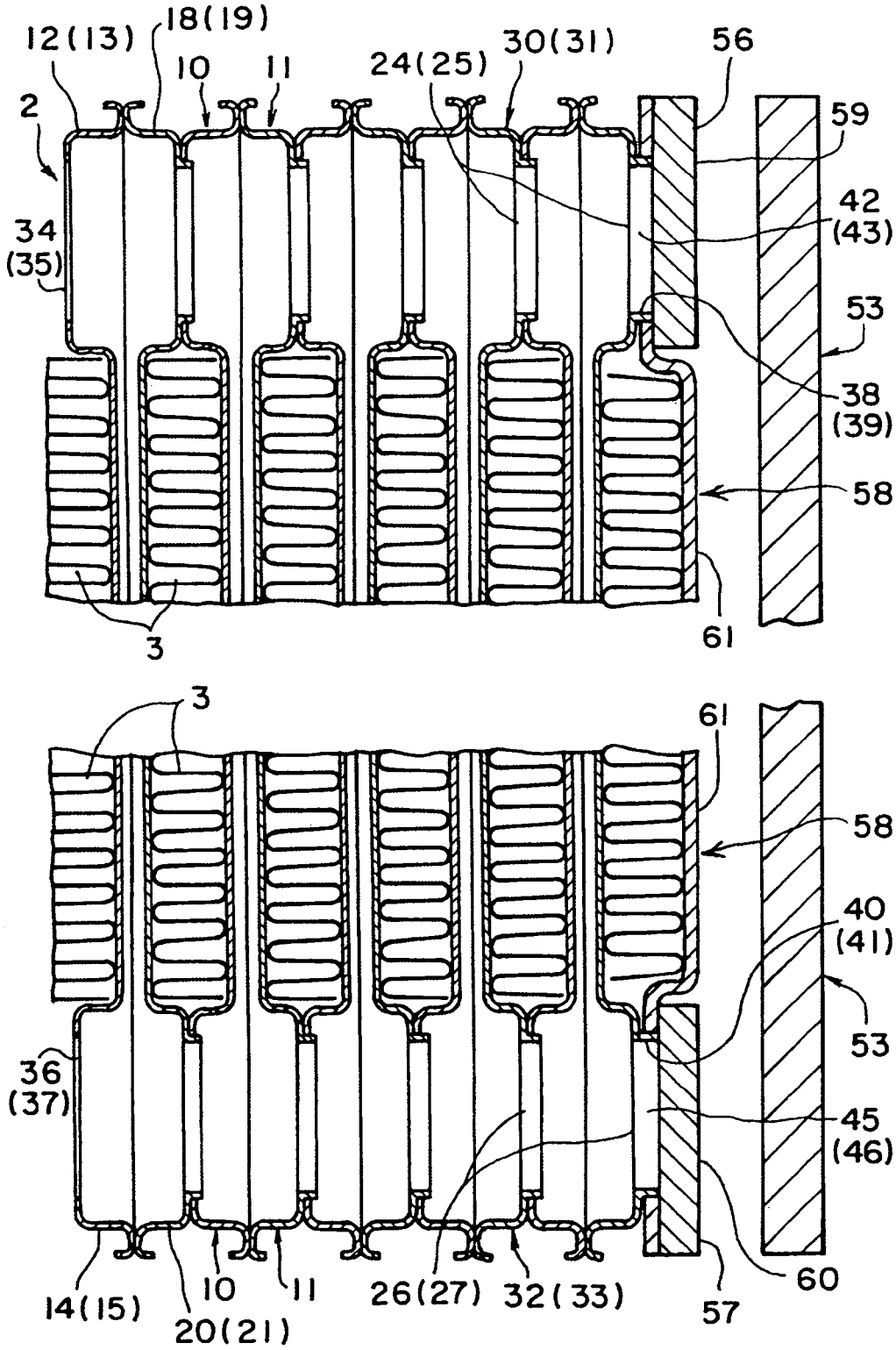
FIG. 12 is a partial, vertical, cross-sectional view of a stacking-type, multi-flow, heat exchanger, according to a modification of the second embodiment depicted in FIG. 11, using another lid, and showing an assembly when the heat exchanger is brazed.
Figure 13:
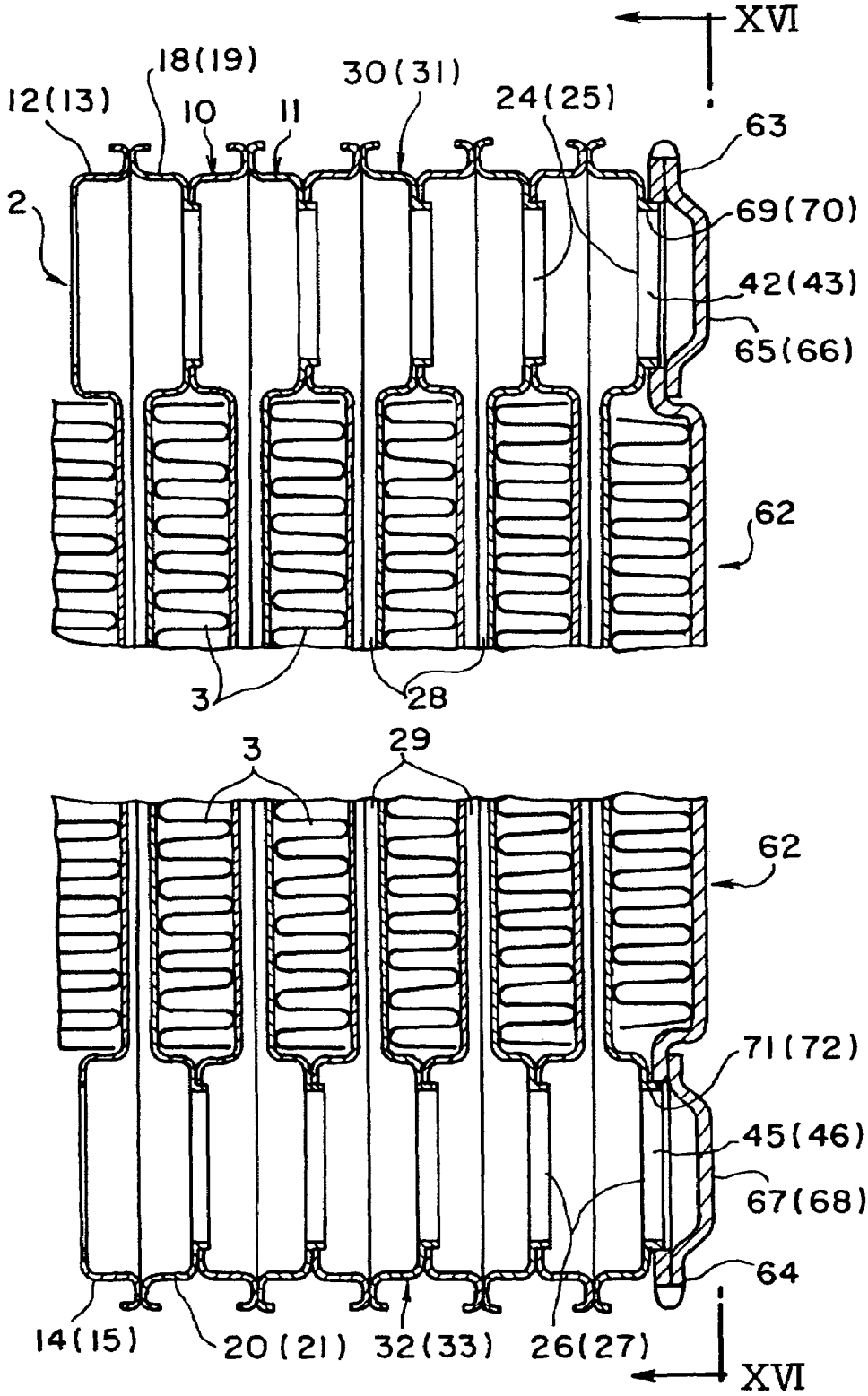
FIG. 13 is a partial, vertical, cross-sectional view of a stacking-type, multi-flow, heat exchanger, according to a third embodiment of the present invention.

As depicted in FIG. 12, by forming lids 56 and 57 as thick members, outer surfaces 59 and 60 of the lids 56 and 57 may be substantially flush relative to outer surface 61 of a portion of end plate 58, which is connected to the outermost fin. Therefore, it is not necessary to provide thicker portions 54 and 55 to brazing jig 53 as in the first embodiment, and the structure of the brazing jig 53 may be simplified and the fixing strength thereof may be increased. Moreover, by forming lids 56 and 57 as thicker members, the pressure resistance of the portions provided therewith may be further increased.

Figure 14:
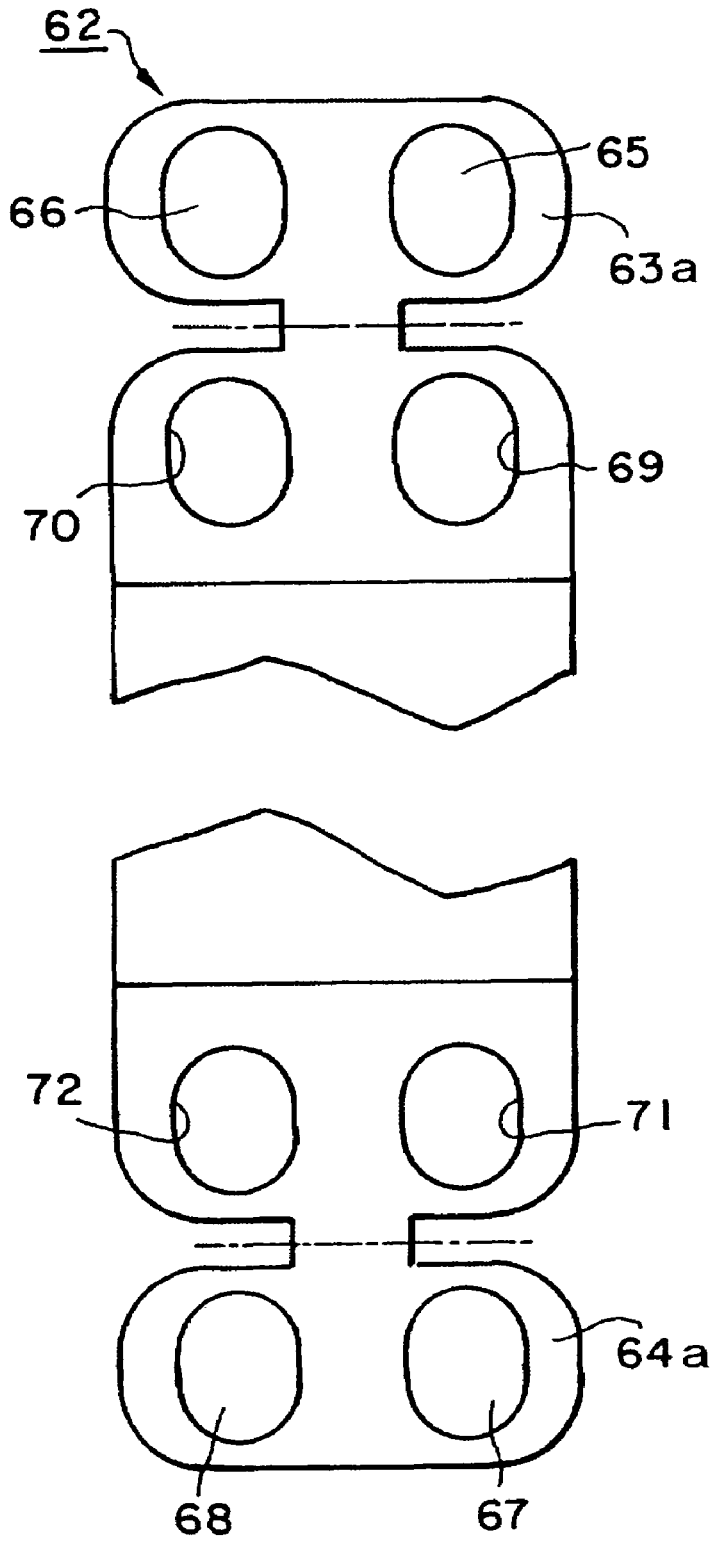
FIG. 14 is an elevational view of an end plate of the heat exchanger depicted in FIG. 13.
Figure 15A:
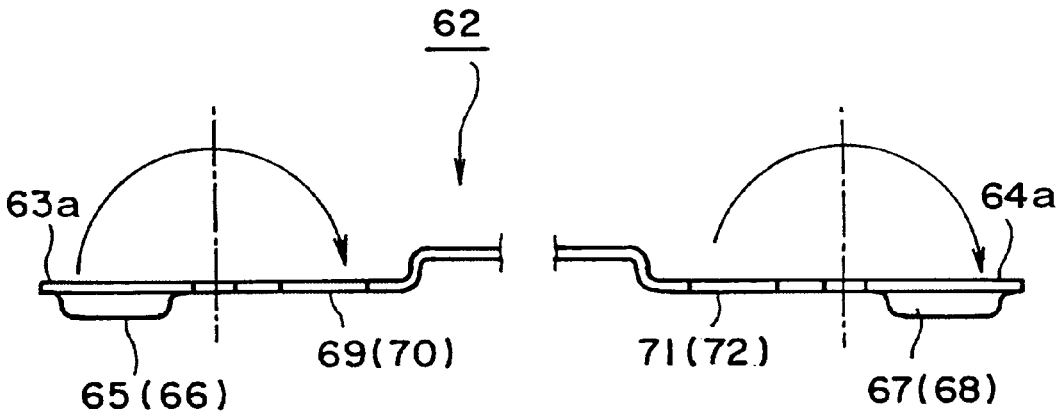
FIGS. 15A and 15B are side views of an end plate of the heat exchanger depicted in FIG. 13, showing a turning-back process for manufacturing the end plate.
Figure 15B:
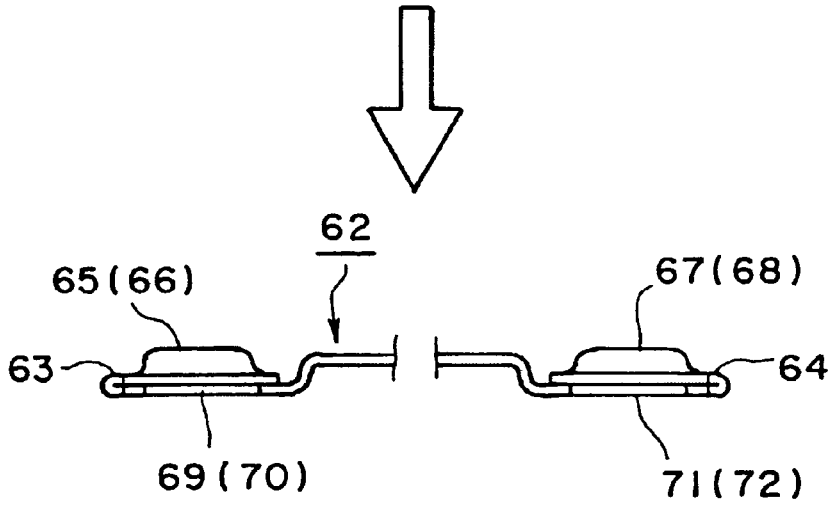
Figure 16:
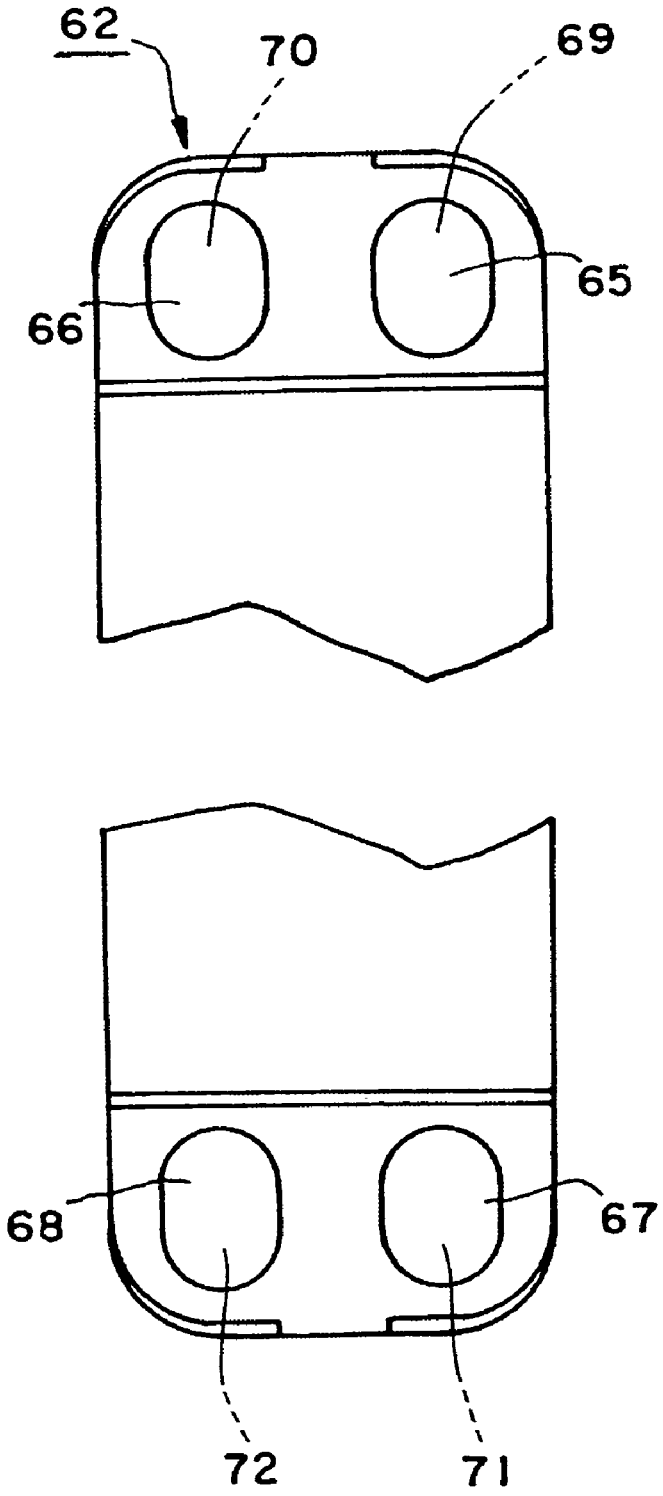
FIG. 16 is an end view of the heat exchanger depicted in FIG. 13, as viewed along Line XVI-XVI of FIG. 13.

FIGS. 13 to 16 depict a stacking-type, multi-flow, heat exchanger and the method for manufacturing such a heat exchanger, according to a third embodiment of the present invention. In this embodiment, as depicted in FIG. 14, lid forming portions 63*a* and 64*a* are formed integrally with end plate 62 at both end portions of end plate 62 in its longitudinal direction. Protruded portions 65, 66, 67, and 68 are formed on lid forming portions 63*a* and 64*a*, respectively. As depicted in FIGS. 15A and 15B, by turning back lid forming portions 63*a* and 64*a*, lids 63 and 64 are formed, and the lids 63 and 64 cover holes 69, 70, 71, and 72 provided on end plate 62, respectively, as depicted in FIG. 16.

Figure 17:
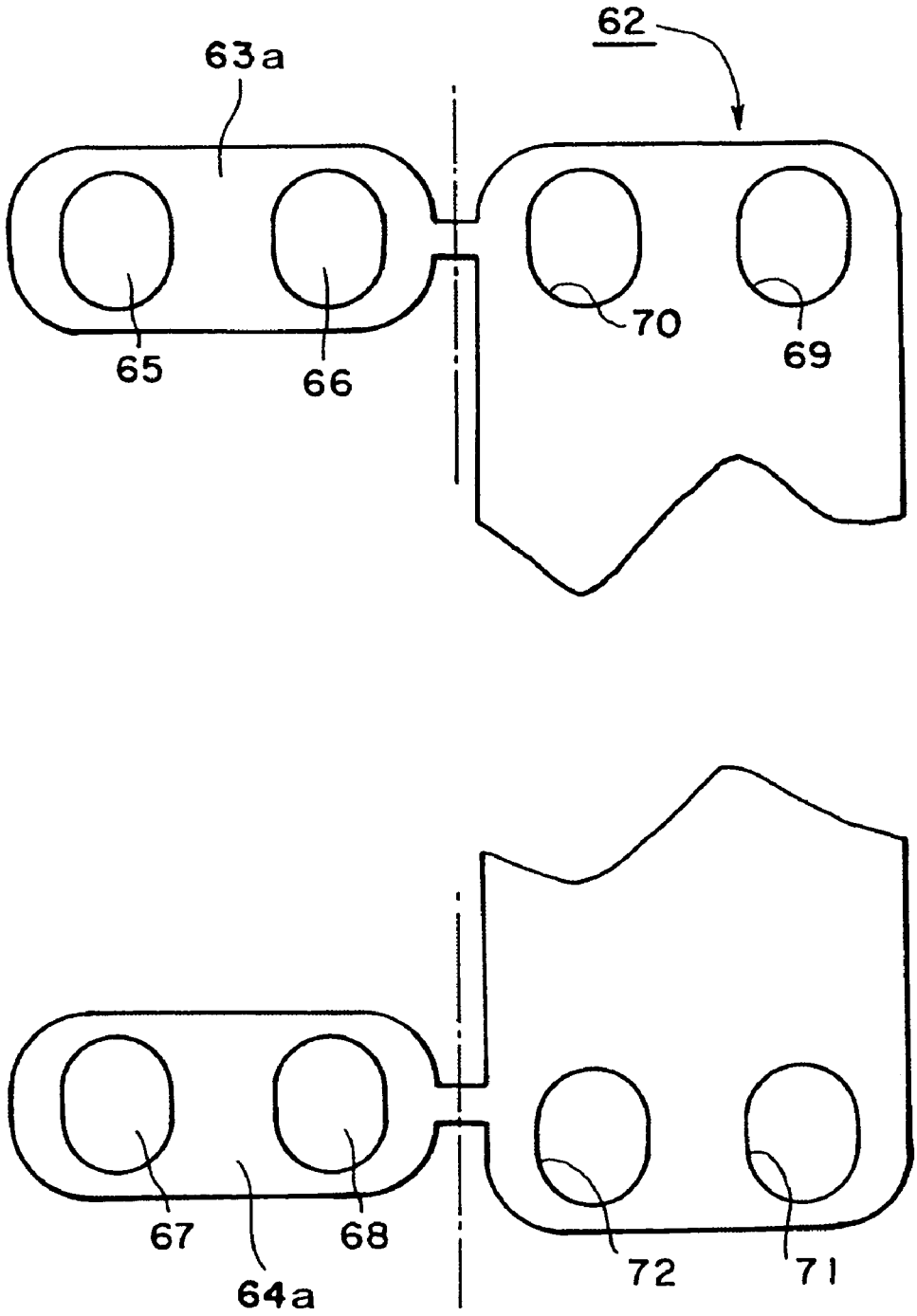
FIG. 17 is an elevational view of an end plate of the heat exchanger depicted in FIG. 13, showing another embodiment different from that depicted in FIG. 14.
Figure 18:
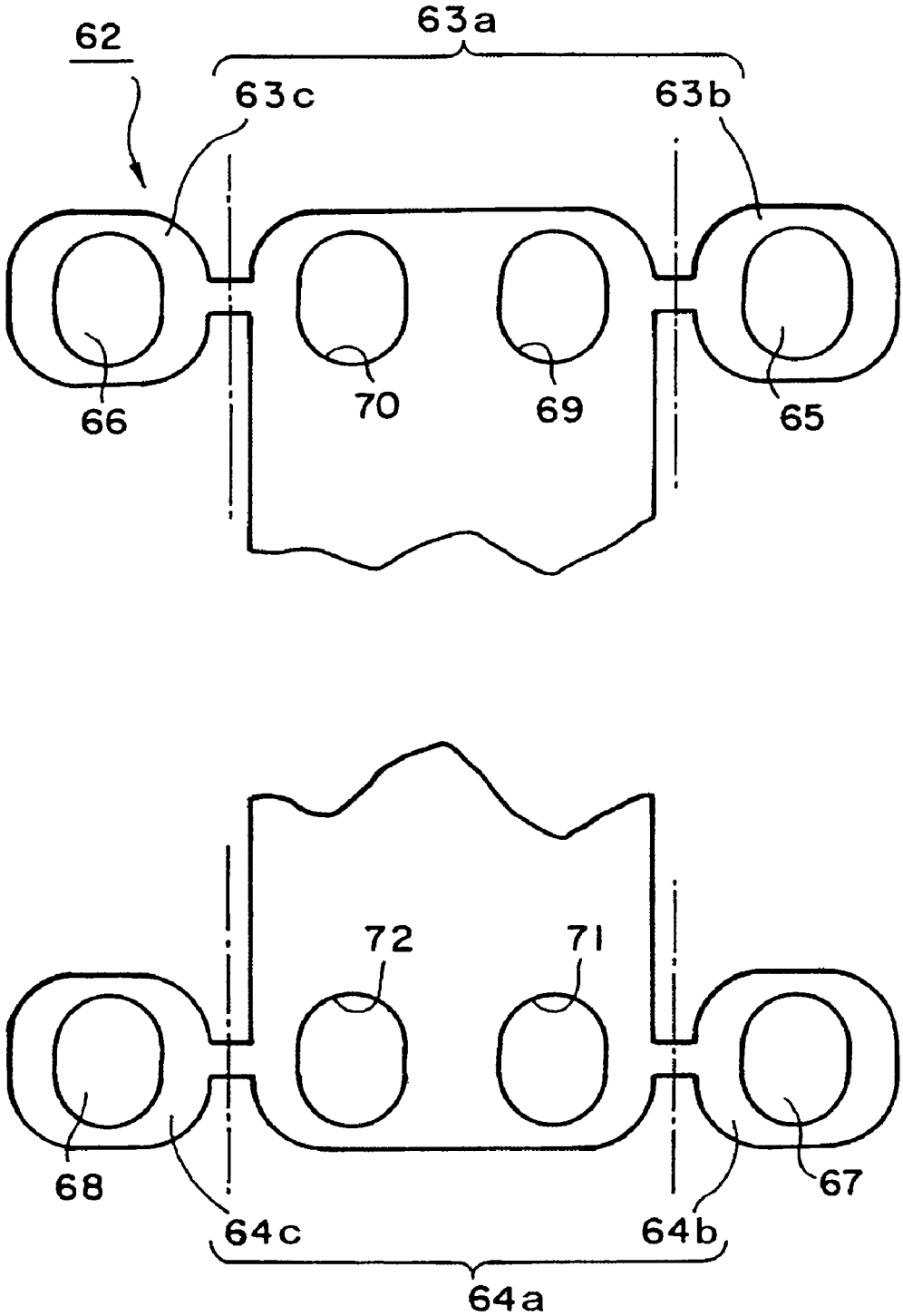
FIG. 18 is an elevational view of an end plate of the heat exchanger depicted in FIG. 13, showing a further embodiment different from that depicted in FIG. 14.

Moreover, in this embodiment, because raised portions 24, 25, 26, and 27 of second tube plate 11 are inserted into holes 69, 70, 71, and 72 of end plate 62, respectively, end plate 62 may be positioned with a high degree of accuracy similar to that in the first embodiment, and the brazing properties may be improved. Further, in this embodiment, because protruded portions 65, 66, 67, and 68 are provided to lids 63 and 64 of end plate 62, openings 42, 43, 45, and 46 of the respective raised portions are closed by the corresponding lids, and the strength and the pressure resistance of the closing portions may be increased. Thus, lid forming portions 63*a* and 64*a* may be formed at the positions depicted in FIG. 17. In addition, as depicted in FIG. 18, lid forming portion 63*a* and lid forming portion 64*a* may be formed as separate portions 63*b* and 63*c* and separate portions 64*b* and 64*c*, respectively. Even in such structures, a target end plate 62 may be formed by turning back the respective lid forming portion, for example, at the respective dashed line shown in FIGS. 17 and 18.

Figure 19:
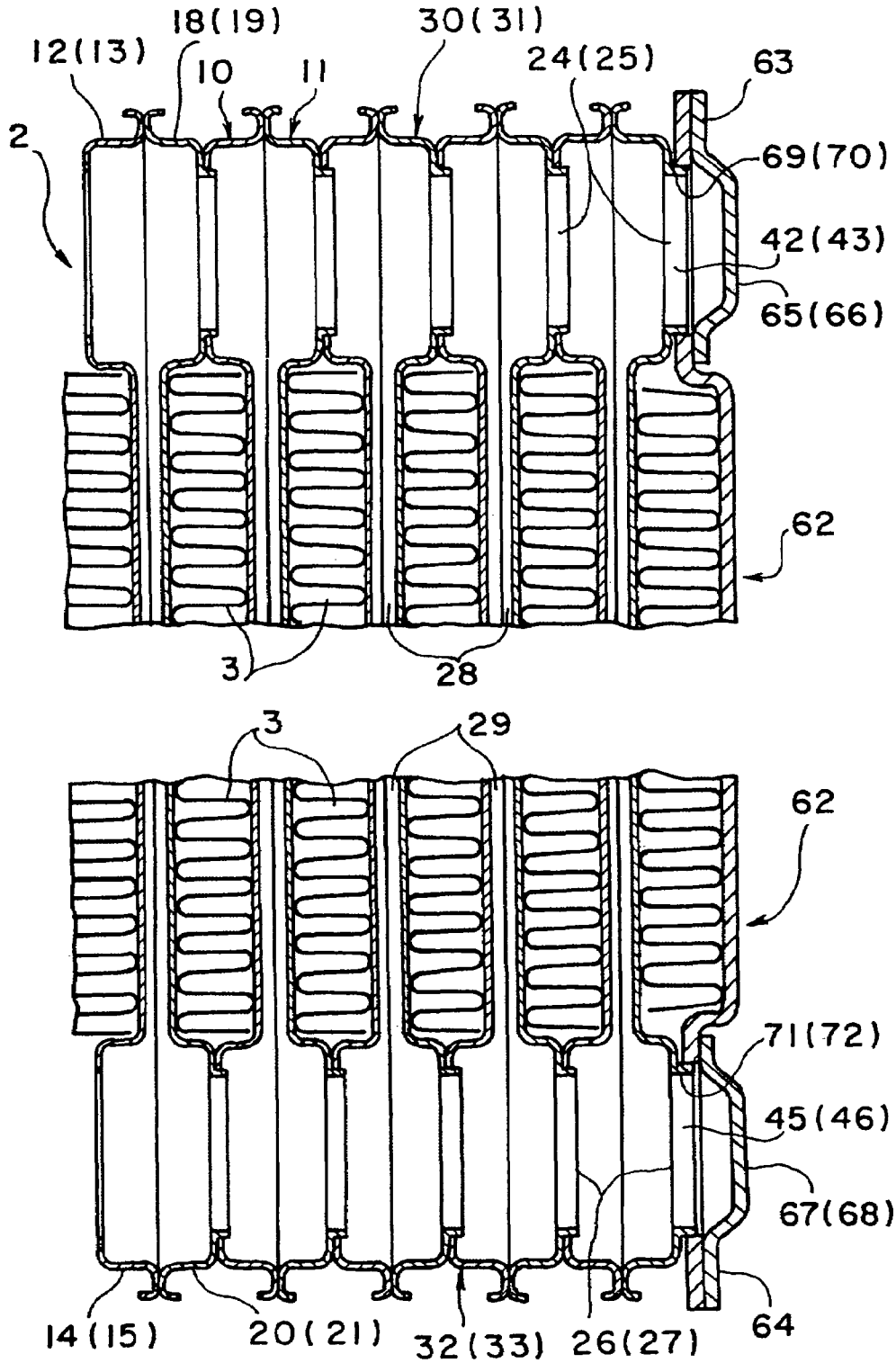
FIG. 19 is a partial, vertical, cross-sectional view of a stacking-type, multi-flow, heat exchanger, according to a fourth embodiment of the present invention.

FIG. 19 depicts a stacking-type, multi-flow, heat exchanger, according to a fourth embodiment of the present invention. In this embodiment, lids 63 and 64 are formed as members separate from end plate 62. Moreover, in this embodiment, similar to that depicted in the third embodiment, the brazing properties and the pressure resistance may be increased.

Figure 20:
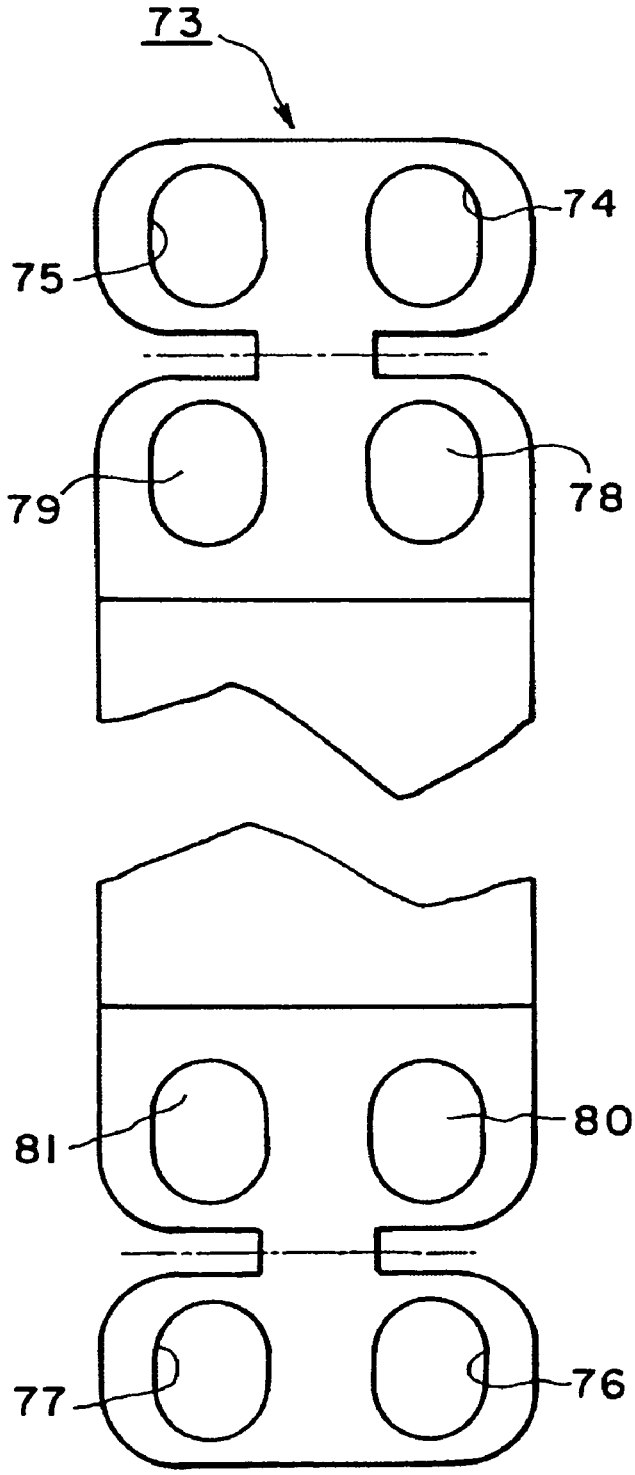
FIG. 20 is an elevational view of an end plate of a stacking-type, multi-flow, heat exchanger, according to a fifth embodiment of the present invention.
Figure 21A:
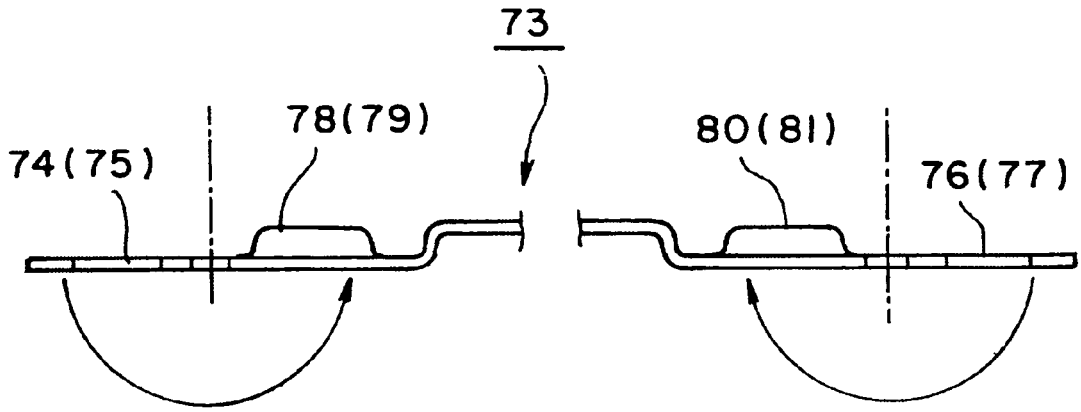
FIGS. 21A and 21B are side views of the end plate depicted in FIG. 20, showing a turning-back process for manufacturing the end plate.
Figure 21B:
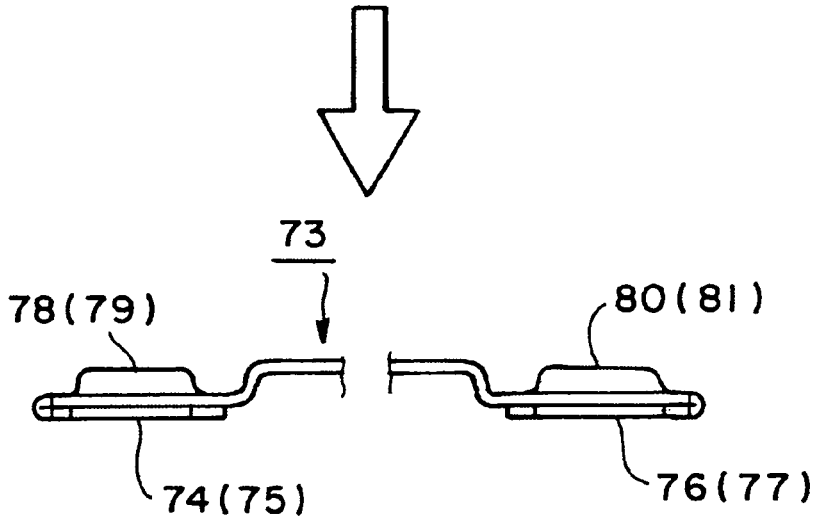
Figure 22:
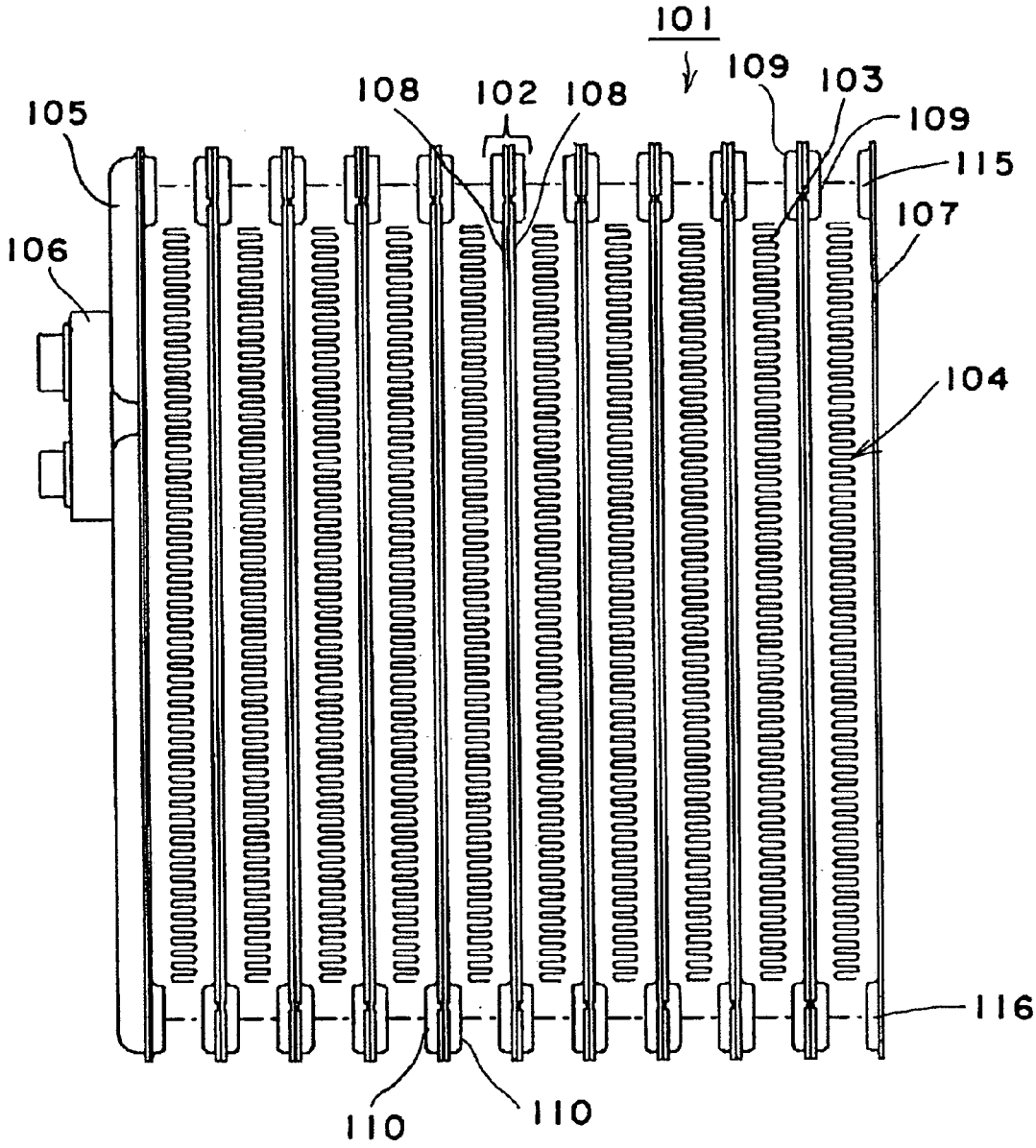
FIG. 22 PRIOR ART
FIG. 22 is an exploded, side view of a known, stacking-type, multi-flow, heat exchanger.
Figure 23:
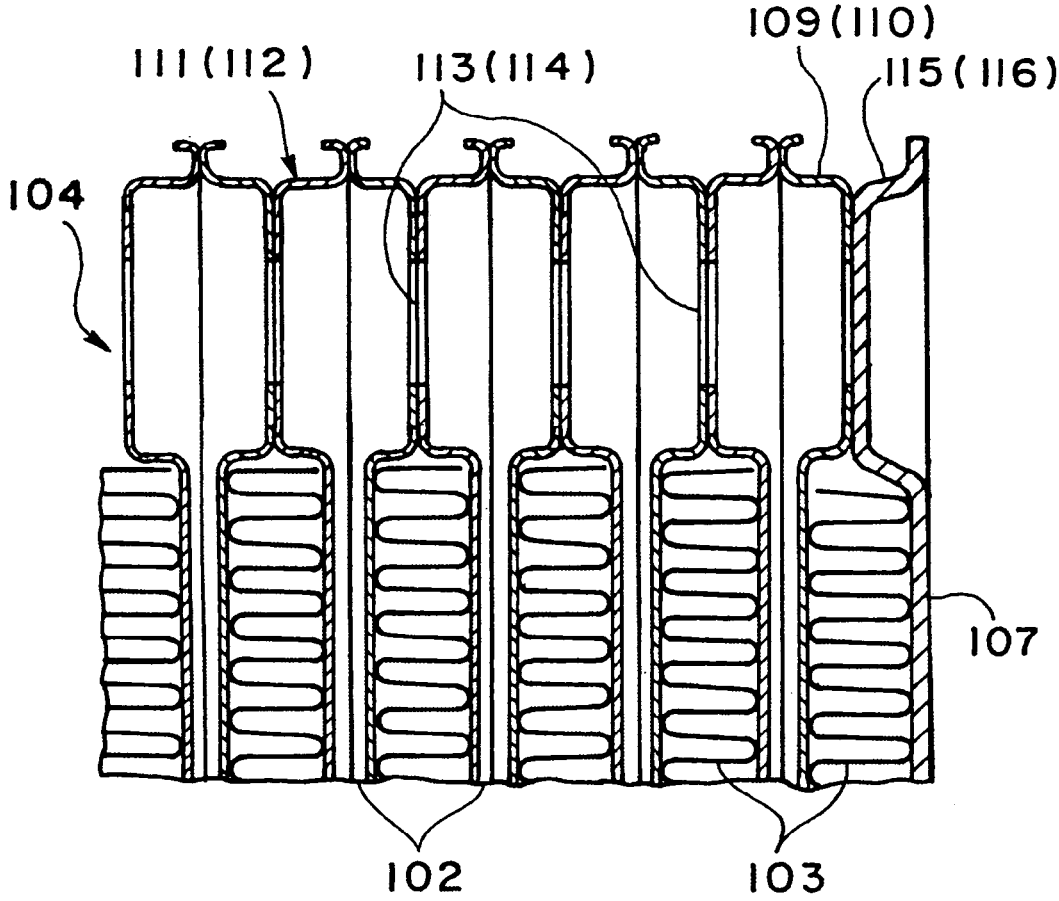
FIG. 23 PRIOR ART
FIG. 23 is an enlarged, partial, vertical, cross-sectional view of the heat exchanger depicted in FIG. 22.
Figure 24:
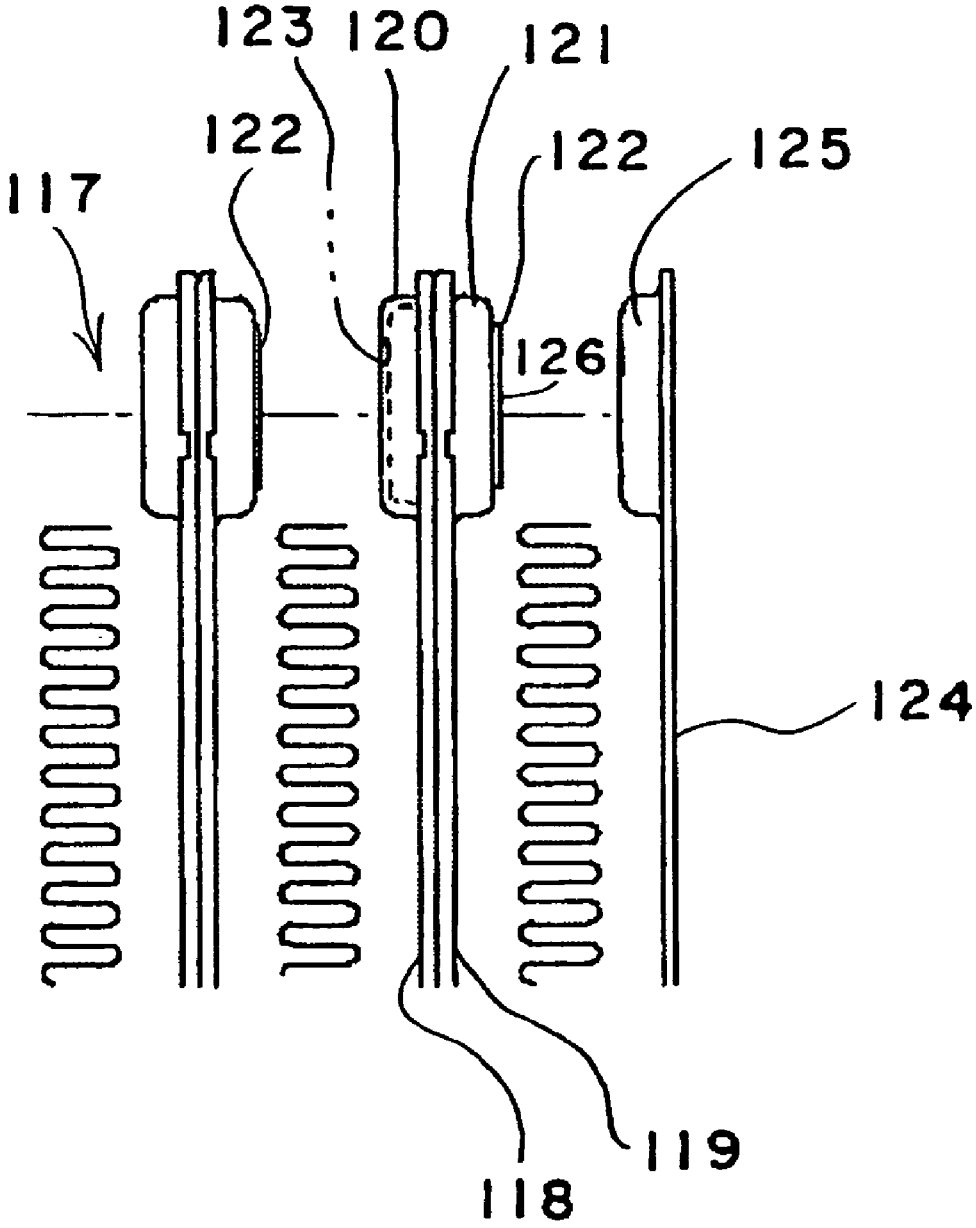
FIG. 24 PRIOR ART
FIG. 24 is an exploded, partial, side view of another known, stacking-type, multi-flow, heat exchanger.

FIGS. 20 and 21 depict an end plate 73 of a stacking-type, multi-flow, heat exchanger and a process of manufacturing such a heat exchanger, according to a fifth embodiment of the present invention. In this embodiment, the positional relationship between holes 74, 75, 76, and 77 and protruded portions 78, 79, 80, and 81 in end plate 73 is reversed as compared with that in end plate 62 of the third embodiment. As depicted in FIGS. 21A and 21B, by turning back the respective hole forming portions, holes 74, 75, 76, and 77 are closed by the corresponding, respective protruded portions 78, 79, 80, and 81. Moreover, in this embodiment, the same function of the end plate may be achieved as that in the above-mentioned embodiments.

The above-described end plates 9, 58, 62, and 73 may be formed by a single process such as pressing, stamping, or the like, and by turning back the predetermined portions of the end plates thus formed, target end plates may be readily manufactured. Further, by setting the outer surfaces of the respective, protruded portions of the end plate and the outer surface of the portion of the end plate connected to an outermost fin to be substantially flush, the brazing may be facilitated by using a simple brazing jig, as depicted in FIG. 12.

The present invention may be applied to any stacking-type, multi-flow, heat exchanger comprising an end plate and, especially, may be applied suitably to a stacking-type, multi-flow, heat exchanger for use in an air conditioner for vehicles.

While the invention has been described in connection with preferred embodiments, it will be understood by those skilled in the art that variations and modifications of the preferred embodiments described above may be made without departing from the scope of the invention. Other embodiments will be apparent to those skilled in the art from a consideration of the specification or from a practice of the invention disclosed herein. It is intended that the specification and the described examples are considered exemplary only, with the true scope of the invention indicated by the following claims.

What is claimed is:

1. A stacking-type, multi-flow, heat exchanger comprising a heat exchanger core comprising a plurality of heat transfer tubes each formed by connecting a pair of tube plates to each other and a plurality of fins, which are stacked alternately, and a tank portion formed at least at an end of said plurality of heat transfer tubes, and an end plate connected to an outermost tube plate of said heat exchanger core, said heat exchanger comprising:

a projecting portion provided on a surface of said outermost tube plate at least at an end portion of said outermost tube plate for forming a part of said tank;

a raised portion with an opening formed though said projecting portion; and an engaging portion and a closing portion provided integrally to said end plate for engaging said raised portion and for closing said opening of said raised portion, wherein said engaging portion comprises a hole provided through said end plate for engaging said raised portion.

2. The heat exchanger of claim 1, wherein said closing portion comprises a lid closing said opening of said raised portion.

3. The heat exchanger of claim 2, wherein said lid is formed integrally with said end plate.

4. The heat exchanger of claim 3, wherein said lid is formed by turning back an extended portion formed on an end of said end plate.

5. The heat exchanger of claim 2, wherein said lid is formed to comprise a portion protruded from said raised portion.

6. The heat exchanger of claim 5, wherein an outer surface of said protruded portion and an outer surface of a portion of said end plate connected to an outermost fin are formed to be substantially flush.

7. A method for manufacturing a stacking-type, multi-flow, heat exchanger, said heat exchanger comprising a heat exchanger core comprising a plurality of heat transfer tubes, said method comprising the steps of:

forming said heat exchanger tubes by connecting a pair of tube plates to each other;

stacking said plurality of tubes alternatively with a plurality of fins to form said core; and forming a tank portion at least at an end of said core by connecting an end plate to an outermost tube plate of said core, wherein said tank portion is formed by providing a projecting portion on a surface of said outermost tube plate at least at an end portion of said outermost tube plate for forming a part of said tank, surrounding an opening formed through said projecting portion with a raised portion, and providing an engaging portion and a closing portion to said end plate for engaging said raised portion and for closing said opening of said raised portion, wherein said engaging portion comprises a hole provided through said end plate for engaging said raised portion.

8. The method of claim 7, wherein said closing portion comprises a lid closing said opening of said raised portion.

9. The method of claim 8, further comprising the step of forming said lid integrally with said end plate.

10. The method of claim 9, wherein the step of forming said lid further comprises turning back an extended portion formed on an end of said end plate.

11. The method of claim 8, further comprising the step of forming said lid to comprise a portion protruded from a position of said raised portion.

12. The method of claim 11, wherein the step of forming said lid further comprises forming an outer surface of said protruded portion and an outer surface of a portion of said end plate connected to an outermost fin to be substantially flush.

13. The method of claim 7, further comprising the step of fixing said assembled heat exchanger with a jig and brazing said heat exchanger.

14. A stacking-type, multi-flow, heat exchanger comprising a heat exchanger core comprising a plurality of heat transfer tubes each formed by connecting a pair of tube plates to each other and a plurality of fins, which are stacked alternately, and a tank portion formed at least at an end of said plurality of heat transfer tubes, and an end plate connected to an outermost tube plate of said heat exchanger core, said heat exchanger comprising:

a projecting portion provided on a surface of said outermost tube plate at least at an end portion of said outermost tube plate for forming a part of said tank;

a raised portion with an opening formed through said projecting portion; and an engaging portion and a closing portion provided integrally to said end plate for engaging said raised portion and for closing said opening of said raised portion, wherein said closing portion comprises a lid closing said opening of said raised portion, and said lid is formed integrally with said end plate, wherein said lid is formed by turning back an extended portion formed on an end of said end plate.

15. A method for manufacturing a stacking-type, multi-flow, heat exchanger, said heat exchanger comprising a heat exchanger core comprising a plurality of heat transfer tubes, said method comprising the steps of:

forming said heat exchanger tubes by connecting a pair of tube plates to each other;

stacking said plurality of tubes alternatively with a plurality of fins to form said core;

forming a tank portion at least at an end of said core by connecting an end plate to an outermost tube plate of said core, wherein said tank portion is formed by providing a projecting portion on a surface of said outermost tube plate at least at an end portion of said outermost tube plate for forming a part of said tank, surrounding an opening formed through said projecting portion with a raised portion, and providing an engaging portion and a closing portion to said end plate for engaging said raised portion and for closing said opening of said raised portion, wherein said closing portion comprises a lid closing said opening of said raised portion; and forming said lid integrally with said end plate, wherein the step of forming said lid further comprises the step of turning back an extended portion formed on an end of said end plate.

* * * * *